US010448675B2

(12) United States Patent
Cherneski

(10) Patent No.: US 10,448,675 B2
(45) Date of Patent: Oct. 22, 2019

(54) CONSTRUCTION OF A GRIPPING FABRIC

(71) Applicant: TruSox LLC, Glen Burnie, MD (US)

(72) Inventor: James Paul Cherneski, Bel Air, MD (US)

( * ) Notice: Subject to any disclaimer, the term of this patent is extended or adjusted under 35 U.S.C. 154(b) by 24 days.

(21) Appl. No.: 15/335,200

(22) Filed: Oct. 26, 2016

(65) Prior Publication Data

US 2017/0042255 A1 Feb. 16, 2017

Related U.S. Application Data

(63) Continuation of application No. 13/219,713, filed on Aug. 29, 2011, now Pat. No. 9,498,003.

(60) Provisional application No. 61/379,907, filed on Sep. 3, 2010.

(51) Int. Cl.

| | |
|---|---|
| ***A41B 11/00*** | (2006.01) |
| ***A41B 17/00*** | (2006.01) |
| ***D06N 7/00*** | (2006.01) |
| ***D04B 11/28*** | (2006.01) |

(52) U.S. Cl.

CPC ..... *A41B 11/008* (2013.01); *A41B 17/00* (2013.01); *D04B 11/28* (2013.01); *D06N 7/0092* (2013.01); *A41B 2400/80* (2013.01); *A41B 2400/82* (2013.01); *D06N 2209/106* (2013.01); *D06N 2211/10* (2013.01); *D06N 2211/106* (2013.01); *Y10T 428/24818* (2015.01)

(58) Field of Classification Search

CPC ..... A41B 2400/80; A41B 2400/82; D06N 7/0092; D06N 2209/106

See application file for complete search history.

(56) References Cited

U.S. PATENT DOCUMENTS

| | | | | |
|---|---|---|---|---|
| 5,948,707 A * | 9/1999 | Crawley | A41D 31/02 | 428/422 |
| 7,383,591 B1 * | 6/2008 | Getzwiller | A41B 11/08 | 2/161.1 |
| 7,748,240 B1 * | 7/2010 | Cherneski | A41B 11/008 | 2/239 |
| 2005/0120463 A1 * | 6/2005 | Cacioppo | A41B 11/008 | 2/239 |
| 2007/0028365 A1 * | 2/2007 | Williams | A41B 11/00 | 2/239 |

* cited by examiner

*Primary Examiner* — Alex A Rolland

(74) *Attorney, Agent, or Firm* — Ashok Tankha

(57) ABSTRACT

A gripping fabric and method for construction thereof is provided. A fabric structure that defines an inner surface and an outer surface is created. The fabric structure or the gripping fabric is configured to conform to a user's body part for constructing a garment, for example, a sock. The inner surface is proximal to a user contact surface and distal to an external contact surface. The outer surface is proximal to the external contact surface and distal to the user contact surface. A gripping material is selectively applied on the inner surface and/or the outer surface of the fabric structure. The gripping material on the inner surface and the outer surface of the fabric structure adheres to the user contact surface and the external contact surface respectively, thereby providing grip between the user contact surface and the fabric structure, and grip between the fabric structure and the external contact surface.

15 Claims, 24 Drawing Sheets

CONSTRUCTION OF A GRIPPING FABRIC

CROSS REFERENCE TO RELATED APPLICATIONS

This application claims the benefit of provisional patent application No. 61/379,907 titled "Construction Of A Foot Gripping Garment" filed on Sep. 3, 2010 and non-provisional patent application Ser. No. 13/219,713 titled "Construction of a Gripping Fabric" filed Aug. 29, 2011, now U.S. Pat. No. 9,498,003.

The above referenced applications are incorporated herein by reference in their entirety.

BACKGROUND

Conventional fabric materials are generally created by interlacing two distinct sets of yarns to form a fabric. A fabric created through a conventional manufacturing process has a low coefficient of friction and is not suitable for providing non-slip contact between the fabric and a user's body that is in contact with the fabric of a garment, for example, a sock, a glove, etc.

Moreover, conventional fabrics, due to their low coefficients of friction, cause slippage between the fabric of the garment and the surface of the body in contact with the garment during use when they come in contact with elements, for example, sweat from the user's body, dust, moisture, air, etc. For example, in sports that involve running, skating, etc., where the user is required to quickly or abruptly change directions while engaged in a sports activity, the user's foot tends to slip inside a sock worn by the user, and also the sock tends to slip inside a shoe worn by the user due to lack of sufficient grip between the foot and the sock and between the foot and the shoe respectively when the sock is made of a conventional fabric. This slippage also increases the response time when the user moves in a new direction. Lack of sufficient grip may also cause the user playing the sport to slip or roll inside the shoe and suffer injuries. For example, the foot of the user wearing a sock made of a conventional fabric and a shoe may slip inside the shoe during a sharp turn leading to an ankle injury. Moreover, the foot of the user wearing the shoe may slip within the sock made of the conventional fabric, which results in the foot moving inside the shoe that may cause an injury to the foot or the ankle of the user. Socks constructed using a conventional fabric do not provide sufficient grip to the user's foot when the user is engaged in a sports activity that requires sharp or abrupt turns.

Furthermore, different sports activities require gripping contact to be established at different sections of the user's body. For example, a user playing golf requires a steady gripping contact between a part of the user's hand that holds a golf club instead of the entire hand. In another example, a user engaged in running would require a steady gripping contact between the forefoot section and the hind foot section of the user's foot and the shoe. Hence, there is a need for constructing a gripping fabric and a gripping garment that has selective gripping sections, and a gripping fabric that can be selectively attached to or integrated into different sections of the user's garment.

Hence, there is a long felt but unresolved need for constructing a gripping fabric that provides a selective grip or a complete grip to surfaces that are in contact with the gripping fabric. Moreover, there is a need for constructing a gripping garment that provides grip to a user's body part, for example, a foot, a hand, etc., between the user's body part and the gripping garment and prevents the user's body part from slipping inside the gripping garment, for example, a sock, a glove, etc. Furthermore, there is a need for constructing a gripping garment that provides grip to the user's body part, for example, a foot between the gripping garment and an external contact surface, for example, the inside surface of a shoe to prevent the gripping garment from slipping against the external contact surface. Furthermore, there is a need for constructing a gripping garment that provides simultaneous grip to the user's body part, for example, a foot between the user's body part and the gripping garment and also between the gripping garment and an external contact surface, for example, the inside surface of a shoe.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The gripping fabric and the method of gripping fabric construction disclosed herein address the above stated need for providing a selective grip or a complete grip to surfaces that are in contact with the gripping fabric. As used herein, the term "gripping fabric" refers to a fabric structure comprising one of natural threads, synthetic threads, gripping threads, or any combination thereof, to which a gripping material, for example, a non-slip material, a tacky material, and/or a textured material is selectively applied. Also, as used herein, the term "fabric structure" refers to a network of one of natural threads, synthetic threads, gripping threads, or any combination thereof, that can be configured or knitted, for example, using a knitting machine, to construct a garment, for example, a sock, a glove, etc.

A gripping garment, for example, a gripping sock, a gripping glove, etc., may be constructed by configuring the fabric structure to conform to a user's body part, for example, a foot, a hand, etc., and then selectively applying the gripping material to the configured fabric structure. A gripping garment may also be constructed using the gripping fabric disclosed herein. The gripping garment disclosed herein provides grip to a user's body part, for example, a foot, a hand, etc., between the user's body part and the gripping garment and prevents the user's body part from slipping inside the gripping garment. The gripping garment disclosed herein also provides grip to the user's body part, for example, a foot between the gripping garment and an external contact surface, for example, the inside surface of footwear, to prevent the gripping garment from slipping against the external contact surface. In an embodiment, the gripping garment disclosed herein provides simultaneous grip to the user's body part between the user's body part and the gripping garment and also between the gripping garment and an external contact surface. For example, the gripping garment such as a gripping sock worn by the user provides grip to a user's foot between the user's foot and the gripping sock, and simultaneously provides grip to the user's foot between the gripping sock and the inside surface of footwear worn by the user.

The method for constructing a gripping fabric disclosed herein comprises creating a fabric structure that defines an inner surface and an outer surface, and selectively applying a gripping material, for example, a non-slip material, a tacky material, and/or a textured material, on the inner surface and/or the outer surface of the fabric structure. As used herein, the "gripping material" refers to a non-slip, sticky, and/or textured material that exhibits generally high surface adhesion and provides grip between a user contact surface and the fabric structure to which the gripping material is selectively applied, and simultaneously provides grip between the fabric structure to which the gripping material is selectively applied and an external contact surface. Also, as used herein, the term "user contact surface" refers to a surface, for example, the skin of a user's body part, for example, a foot, a hand, etc., that contacts the inner surface of the fabric structure. Also, as used herein, the term "external contact surface" refers to a surface in external contact with the outer surface of the fabric structure. For example, the external contact surface is the inside surface of footwear worn by the user, which externally contacts the outer surface of a sock configured from the fabric structure and worn by the user on the user's foot.

The fabric structure comprises, for example, a network of natural threads and/or synthetic threads, or a network of gripping threads, or a network of natural threads, synthetic threads, and gripping threads. As used herein, the term "gripping threads" refer to non-slip, sticky, tacky, and/or textured threads that exhibit generally high surface adhesion and provide grip between the user contact surface and a fabric structure made from the gripping threads, and simultaneously provide grip between the fabric structure and the external contact surface. In an embodiment, the gripping threads are made by selectively applying a gripping material to natural threads and/or synthetic threads. In an embodiment, the fabric structure is configured to conform to a user's body part, for example, a foot, a hand, etc., for constructing a garment, for example, a sock, a glove, etc., prior to selective application of the gripping material on the inner surface and/or the outer surface of the fabric structure. For example, the natural threads, the synthetic threads, and/or the gripping threads of the fabric structure are knitted using a knitting machine, to construct a garment, for example, a sock, prior to selective application of the gripping material on the inner surface and/or the outer surface of the sock. The inner surface of the created fabric structure is proximal to the user contact surface and distal to the external contact surface. The outer surface of the created fabric structure is proximal to the external contact surface and distal to the user contact surface.

In an embodiment, the gripping material is configured into one or more of multiple shapes for the selective application of the gripping material on the inner surface and/or the outer surface of the fabric structure. The gripping material selectively applied on one or more of the inner surface and the outer surface of the fabric structure adheres to the user contact surface and the external contact surface respectively. The adherence of the gripping material on the inner surface and the outer surface of the fabric structure to the user contact surface and the external contact surface respectively provides grip between the user contact surface and the fabric structure, and provides grip between the fabric structure and the external contact surface.

In an embodiment, the fabric structure is created by providing multiple gripping threads and supplementary threads; separating the gripping threads into a first gripping thread and a second gripping thread; winding the first gripping thread, the second gripping thread, a first supplementary thread, and a second supplementary thread onto a first spool, a second spool, a third spool, and a fourth spool respectively; grouping the first gripping thread and the first supplementary thread into a first pair; grouping the second gripping thread and the second supplementary thread into a second pair; and knitting the first pair with the second pair to form the fabric structure. As used herein, the term "supplementary thread" refers to an additional thread made from a conventional material, for example, cotton, nylon, polyester, wool, etc., which is knitted along with a gripping thread to create the first pair and the second pair. The first pair defines the inner surface of the fabric structure. The second pair defines the outer surface of the fabric structure. The first gripping thread of the first pair is exposed on the inner surface of the fabric structure, but not exposed on the outer surface of the fabric structure. The second gripping thread of the second pair is exposed on the outer surface of the fabric structure, but not exposed on the inner surface of the fabric structure. The inner surface defined by the first pair provides grip between the user contact surface and the fabric structure. The outer surface defined by the second pair simultaneously provides grip between the fabric structure and the external contact surface.

The gripping threads used for creating the fabric structure are made from non-slip materials, tacky materials, and/or textured materials comprising, for example, one or more of synthetic rubber, natural latex, polyvinyl chloride, plastisol, thermoplastic rubber, thermoplastic elastomers, polyurethane, thermoplastic coatings on conventional threads, etc. The gripping threads are coated, for example, with silicon, talcum powder, etc., to prevent gathering and tangling during creation of the fabric structure. The supplementary threads are selected from materials comprising, for example, cotton, nylon, a polyester or spandex such as Lycra®, wool, etc.

In an embodiment, the first gripping thread and the first supplementary thread are fed from the first spool and the third spool respectively into a first finger tube. The second gripping thread and the second supplementary thread are fed from the second spool and the fourth spool respectively into a second finger tube. In another embodiment, the inner surface and the outer surface of the fabric structure are created by feeding the first gripping thread, the second gripping thread, the first supplementary thread, and the second supplementary thread into a first finger tube, a second finger tube, a third finger tube, and a fourth finger tube respectively. A plating technique is used, for example, to knit the first supplementary thread retrieved from the third finger tube and the second supplementary thread retrieved from the fourth finger tube. The first supplementary thread is exposed on the inner surface of the fabric structure. The second supplementary thread is exposed on the outer surface of the fabric structure. The plating technique is also used to knit the first gripping thread retrieved from the first finger tube and the second gripping thread retrieved from the second finger tube. The first gripping thread is exposed on the inner surface of the fabric structure. The second gripping thread is exposed on the outer surface of the fabric structure. A first pair of the first gripping thread and the first supplementary thread defines the inner surface of the fabric structure. A second pair of the second gripping thread and the second supplementary thread defines the outer surface of the fabric structure.

In an embodiment, the fabric structure is created without the use of a conventional supplementary thread, for example, by knitting only gripping threads to define the inner surface and the outer surface of the fabric structure. In this embodiment, the gripping threads are used exclusively to create the inner surface and the outer surface of the fabric structure. In another embodiment, the fabric structure configured to conform to the user's body part, for example, the user's foot, comprises one or more gripping threads in selective areas, for example, a heel section that accommodates the user's heel, a ball section that accommodates the ball of the user's foot, etc., on the inner surface and the outer surface of the configured fabric structure.

In an embodiment, the gripping material is selectively applied on the first gripping thread and/or the first supplementary thread in the first pair that defines the inner surface of the fabric structure, and on the second gripping thread and/or the second supplementary thread in the second pair that defines the outer surface of the fabric structure. For example, the gripping material can be added to or coated on the first gripping thread and/or the first supplementary thread in the first pair, or on the second gripping thread and/or the second supplementary thread in the second pair at $1/16^{th}$ of an inch intervals instead of coating the entire length of the threads on the spools. In an embodiment, the gripping material can be added to or coated on the entire length of the first gripping thread and/or the first supplementary thread in the first pair, or on the second gripping thread and/or the second supplementary thread in the second pair. The gripping material adheres to the first gripping thread and/or the first supplementary thread in the first pair and to the second gripping thread and/or the second supplementary thread in the second pair. The gripping material on the inner surface defined by the first pair and the outer surface defined by the second pair adheres to the user contact surface and the external contact surface respectively for providing enhanced grip between the user contact surface and the fabric structure, and between the fabric structure and the external contact surface respectively.

In another embodiment, the selective application of the gripping material on the inner surface and/or the outer surface of the fabric structure comprises creating a design frame comprising one or more patterned holes, positioning the created design frame on each of the inner surface and/or the outer surface of the fabric structure, and selectively applying the gripping material on the positioned design frame on the inner surface and/or the outer surface of the fabric structure. The gripping material is selectively applied on the positioned design frame on the inner surface and/or the outer surface of the fabric structure, for example, by one or more of painting, pouring, screen printing, and spraying the gripping material on the positioned design frame to allow the gripping material to pass through the patterned holes of the positioned design frame and adhere to the inner surface and/or the outer surface of the fabric structure in a pattern defined by the patterned holes of the positioned design frame.

In another embodiment, the method for selectively applying the gripping material on the inner surface and/or the outer surface of the fabric structure comprises configuring the gripping material into one or more of multiple shapes, coating one surface of the gripping material with a sealing element, and selectively applying the configured gripping material on the inner surface and/or the outer surface of the fabric structure. The sealing element attaches the configured gripping material to the inner surface and/or the outer surface of the fabric structure. The attached gripping material on the inner surface and the outer surface of the fabric structure adheres to the user contact surface and the external contact surface respectively.

In another embodiment, the selective application of the gripping material on the inner surface and/or the outer surface of the fabric structure is performed, for example, by painting, pouring, screen printing, or spraying the gripping material on the inner surface and/or the outer surface of the fabric structure in one or more of multiple patterns. In another embodiment, the selective application of the gripping material on the inner surface and/or the outer surface of the fabric structure is performed, for example, by using a heat press for transferring the gripping material to the inner surface and/or the outer surface of the fabric structure in one or more of multiple patterns.

In another embodiment, the gripping fabric constructed from the fabric structure with the selectively applied gripping material is configured as patches and selectively attached, for example, by sewing or bonding to one or more sections of a garment wearable by the user for providing grip between the user contact surface and the constructed gripping fabric, and for providing grip between the constructed gripping fabric and the external contact surface. In an embodiment, patches are made of the gripping material, for example, a thermoplastic elastomer, a polyvinyl chloride, natural latex, synthetic latex, synthetic suede, suede leather, synthetic leather, other leathers, etc., instead of being made of the fabric structure to which the gripping material is selectively applied, for example, by painting, pouring, screen printing, spraying, etc., the gripping material on the fabric structure. These patches are selectively attached, for example, by sewing or bonding to one or more sections of a garment wearable by the user. The selectively attached patches contact both the user contact surface and the external contact surface simultaneously.

In another embodiment, the gripping material itself is selectively attached in one or more of multiple patterns to one or more sections of a garment for providing grip between the user contact surface and the garment, and for providing grip between the garment and the external contact surface.

In an embodiment, the constructed gripping fabric comprising the fabric structure with the selectively applied gripping material is configured to conform to a user's body part, for example, a foot, a hand, etc., for constructing a gripping garment, for example, a gripping sock, a gripping glove, etc.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific components and methods disclosed herein.

DETAILED DESCRIPTION OF THE INVENTION

Figure 1:
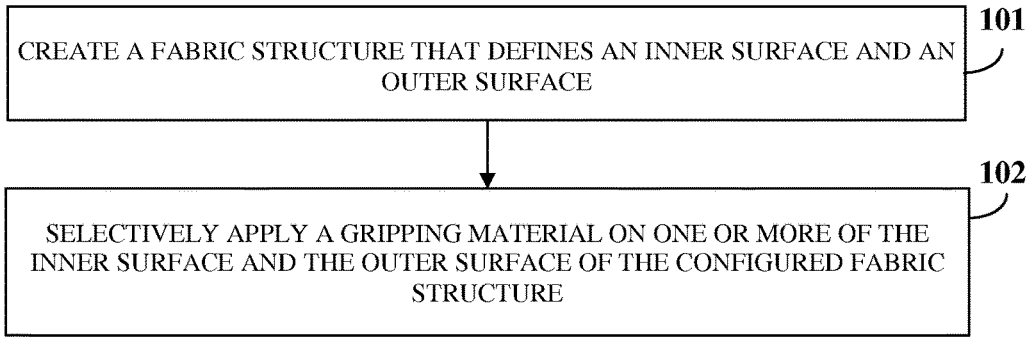
FIG. 1 exemplarily illustrates a method for constructing a gripping fabric.

FIG. 1 exemplarily illustrates a method for constructing a gripping fabric. As used herein, the term "gripping fabric" refers to a fabric structure comprising one of natural threads, synthetic threads, gripping threads, or any combination thereof, to which a gripping material is selectively applied. Also, as used herein, the term "fabric structure" refers to a network of one of natural threads, synthetic threads, gripping threads, or any combination thereof, that can be configured or knitted, for example, using a knitting machine, to construct a garment, for example, a sock, a glove, etc. The gripping fabric is therefore constructed by selectively applying the gripping material to a fabric structure comprising a network of natural threads and/or synthetic threads, or to a fabric structure comprising a network of gripping threads and supplementary threads as disclosed in the detailed description of FIGS. 9-15B, or to a fabric structure comprising only gripping threads. Also, as used herein, the term "gripping material" refers to a non-slip, sticky, and/or textured material that exhibits generally high surface adhesion and provides grip between a user contact surface and a fabric structure to which the gripping material is selectively applied, and simultaneously provides grip between the fabric structure to which the gripping material is selectively applied and an external contact surface. Also, as used herein, the term "user contact surface" refers to a surface, for example, the skin of a user's body part, for example, a foot, a hand, etc., that contacts an inner surface of the fabric structure. Also, as used herein, the term "external contact surface" refers to a surface in external contact with an outer surface of the fabric structure. For example, if the fabric structure is configured to conform to a user's body part, for example, a foot, for constructing a garment, for example, a sock, when the user wears the sock and footwear, the user contact surface is the skin of the user's foot and the external contact surface is the inside surface of the user's footwear.

In the method disclosed herein, a fabric structure that defines an inner surface and an outer surface is created 101. The fabric structure comprises, for example, a network of natural threads and/or synthetic threads, or a network of gripping threads, or a network of one or more of natural threads, synthetic threads, and gripping threads. As used herein, the term "gripping threads" refer to non-slip, sticky, tacky, and/or textured threads that exhibit generally high surface adhesion and provide grip between the user contact surface and a fabric structure made from the gripping threads, and simultaneously provide grip between the fabric structure and the external contact surface. In an embodiment, the gripping threads are made by selectively applying a gripping material to natural threads and/or synthetic threads, for example, by spraying, painting, pouring, etc., the gripping material on the natural threads and/or synthetic threads. In an embodiment, the fabric structure is configured to conform to a user's body part, for example, a foot, a hand, etc., for constructing a garment, for example, a sock, a glove, etc., prior to selective application of the gripping material on the inner surface and the outer surface of the fabric structure. The inner surface of the fabric structure is proximal to the user contact surface and distal to the external contact surface. The outer surface of the fabric structure is proximal to the external contact surface and distal to the user contact surface.

Moreover, in the method disclosed herein, a gripping material is selectively applied 102 on one or more of the inner surface and the outer surface of the configured fabric structure. For example, the gripping material is added to the configured fabric structure, that is, a sock, after the sock is made. The gripping material is a non-slip material, a tacky material, a textured material, or any combination thereof. In an embodiment, the gripping material is made in the form of a sheet having a thickness of, for example, 0.35 millimeters (mm). In an embodiment, the gripping material has a suede type finish and is classified as a non-woven fabric. As used herein, a "textured material" is any coarse or non-uniform finish material, for example, a surface produced when Styrofoam® from the Dow Chemical Company is sprayed onto the surface. The gripping material is made, for example, from natural rubber, synthetic rubber, natural latex, thermoplastic rubber (TPR), thermoplastic elastomers (TPE), polyurethane, polyvinyl chloride, synthetic and/or natural suede-like non-slip finishes, etc. In another example, the gripping material is a synthetic leather-like material, for example, Clarino® manufactured by Kuraray Co., Ltd., Tokyo, Japan.

The gripping material on the inner surface and the outer surface of the fabric structure adheres to the user contact surface and the external contact surface respectively. The adherence of the gripping material on the inner surface and the outer surface of the fabric structure to the user contact surface and the external contact surface respectively provides grip between the user contact surface and the fabric structure, and provides grip between the fabric structure and the external contact surface.

In an embodiment, the gripping material is selectively applied on each of the inner surface and the outer surface of a piece of a conventional fabric to construct a gripping fabric that provides grip between the user contact surface and the gripping fabric, and for providing grip between the gripping fabric and the external contact surface. The piece of conventional fabric is made, for example, from cotton, nylon, wool, acrylic, polyester, polypropylene, spandex, etc., or any combination thereof. Consider an example where a fabric structure comprising a network of natural threads and/or synthetic threads is knitted, for example, using a knitting machine, to construct a garment, for example, a sock, a glove, etc. The gripping material is then selectively applied on each of the inner surface and the outer surface of the garment to construct a gripping garment, for example, a gripping sock. In another embodiment, the gripping material is selectively applied on the inner surface and/or the outer surface of an embodiment of the fabric structure configured into a garment, for example, a sock as disclosed in the detailed description of FIGS. 9-15B, for providing grip between the user contact surface and the configured fabric structure, and for providing grip between the configured fabric structure and the external contact surface. The selective application of the gripping material on this embodiment of the fabric structure is exemplarily illustrated in FIGS. 15A-15B.

In an embodiment, a gripping garment, for example, a gripping sock, a gripping glove, etc., is constructed using the created fabric structure with the selectively applied gripping material on the inner surface and the outer surface of the created fabric structure. This exemplifies the embodiment where a gripping sock, a gripping glove, or other gripping garment is constructed using the gripping fabric disclosed herein. That is, the gripping fabric constructed from the fabric structure with the selectively applied gripping material is configured to conform to a user's body part, for example, a hand, a foot, etc., for creating the gripping garment, for example, a gripping glove, a gripping sock, etc. For example, the gripping fabric is configured to conform to the user's hand to construct a gripping glove. The gripping glove provides grip to the user's hand between the user's hand and the gripping glove. In another example, the gripping fabric comprising the fabric structure with the selectively applied gripping material is configured to conform to the user's foot to construct a gripping sock. The gripping sock provides grip to the user's foot between the user's foot and the gripping sock, and simultaneously provides grip to the user's foot between the gripping sock and the inside surface of footwear worn by the user.

The gripping garment can therefore be constructed by selectively applying the gripping material to a fabric structure that has already been knitted into a garment, for example, a sock, or by configuring the gripping fabric made of the fabric structure with the selectively applied gripping material into a gripping garment, for example, a gripping sock.

In an embodiment, the constructed gripping fabric is configured as a patch and is selectively attached or bonded to one or more sections of a garment wearable by the user for providing grip between the user contact surface and the constructed gripping fabric, and for providing grip between the constructed gripping fabric and the external contact surface. The gripping fabric is attached to an inside surface and/or an outside surface of a garment wearable by the user, for example, by heat-gluing, pressure gluing, sewing, heat-sealing, etc. For example, the constructed gripping fabric is selectively attached to an inside surface and/or an outside surface of a sock, a glove, etc., for providing grip to the user's foot, hand, etc. In an embodiment, the patch of the gripping fabric is sewn into an opening created in the garment wearable by the user. The resulting gripping garment disclosed herein therefore prevents the user's body part from slipping inside the constructed gripping garment, for example, a gripping sock, a gripping glove, etc., and also prevents the constructed gripping garment from slipping against an external contact surface.

Figure 15A:
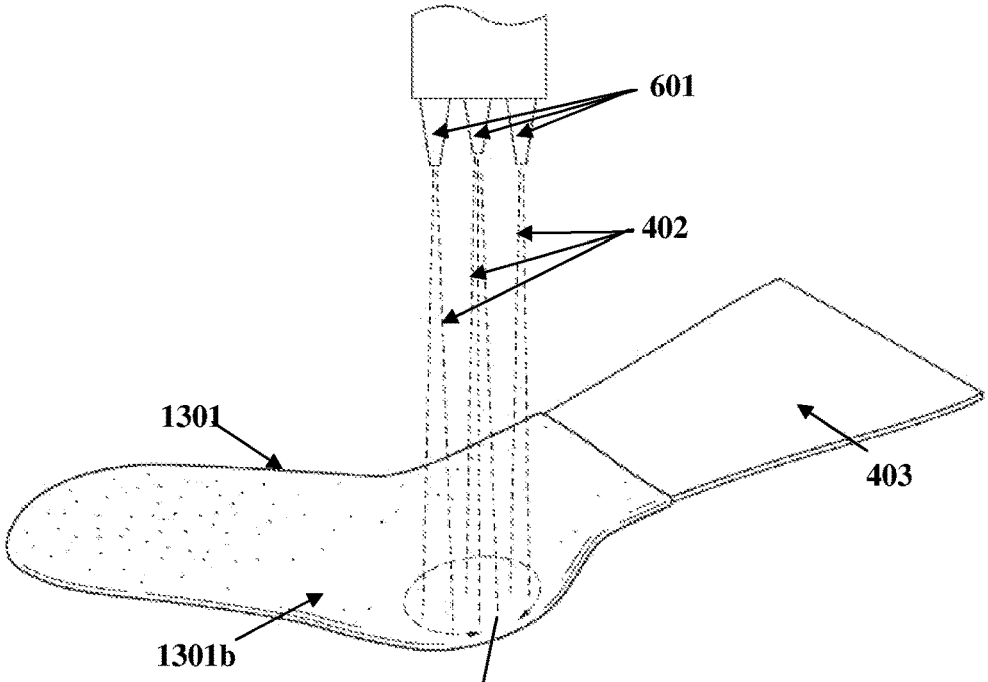
FIGS. 15A-15B exemplarily illustrate selective application of a gripping material on a fabric structure configured to conform to a user's body part as shown in FIGS. 13A-13B, by spraying the gripping material on the configured fabric structure to construct a gripping garment.
Figure 15B:
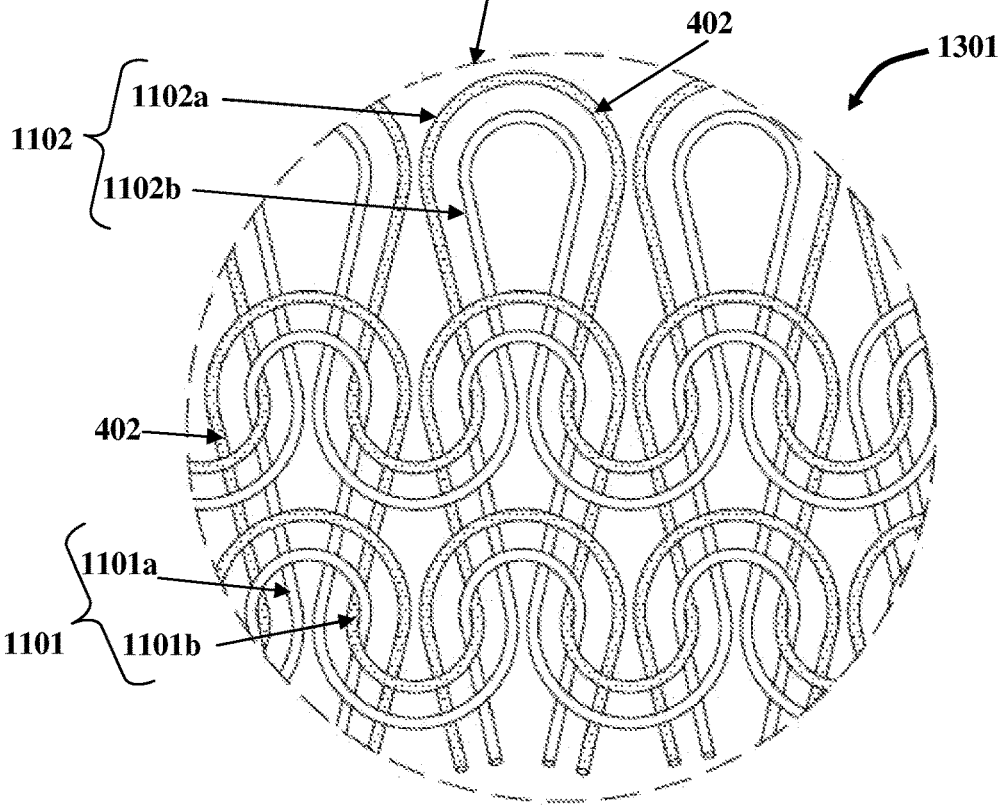

In another embodiment, the fabric structure created by knitting gripping threads with supplementary threads as disclosed in the detailed description of FIGS. 9-14D, is configured as a patch and is selectively attached or bonded to one or more sections of a garment wearable by the user as exemplarily illustrated in FIGS. 7A-7F, for providing grip between the user contact surface and the fabric structure, and for providing grip between the fabric structure and the external contact surface. In another embodiment, the fabric structure created as disclosed in the detailed description of FIGS. 9-14D and selectively applied with the gripping material as disclosed in the detailed description of FIGS. 15A-15B, is configured as a patch and is selectively attached or bonded to one or more sections of a garment wearable by the user as exemplarily illustrated in FIGS. 7A-7F. In another embodiment, the patch is, for example, made of a gripping material, for example, a thermoplastic elastomer, a polyvinyl chloride, natural latex, synthetic latex, synthetic suede, suede leather, synthetic leather, other leathers, etc., instead of being made of the fabric structure to which the gripping material is selectively applied, for example, by painting, pouring, screen printing, spraying, etc., the gripping material on the fabric structure. The patch made of the gripping material is selectively attached, for example, by sewing or bonding to one or more sections of a garment wearable by the user as exemplarily illustrated in FIGS. 7G-7I.

Figure 2:
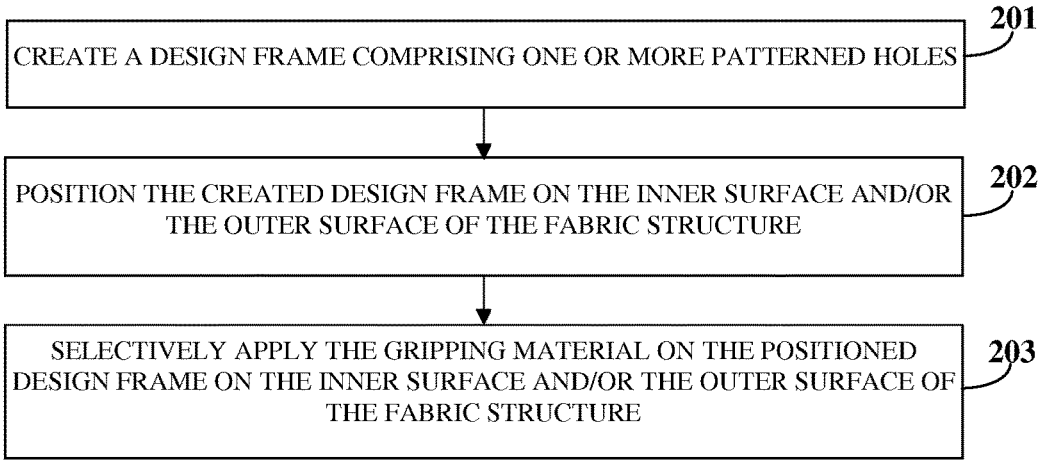
FIG. 2 exemplarily illustrates a method for selectively applying a gripping material on an inner surface and/or an outer surface of a fabric structure.

FIG. 2 exemplarily illustrates a method for selectively applying a gripping material on an inner surface and/or an outer surface of a fabric structure. A design frame 501 is created 201 comprising one or more patterned holes 502 as exemplarily illustrated in FIG. 5A. The created design frame 501 is positioned 202 on the inner surface 401*a* and/or the outer surface 401*b* of the fabric structure 401. The gripping material 402 is selectively applied 203 on the positioned design frame 501 on the inner surface 401*a* and/or the outer surface 401*b* of the fabric structure 401. The gripping material 402 passes through the patterned holes 502 of the positioned design frame 501 and adheres to the inner surface 401*a* and/or the outer surface 401*b* of the fabric structure 401 in a pattern defined by the patterned holes 502 of the positioned design frame 501.

The selective application of the gripping material 402 on the positioned design frame 501 is performed, for example, by one or more of painting, pouring, screen printing, and spraying the gripping material 402 on the positioned design frame 501 to allow the gripping material 402 to pass through the patterned holes 502 of the positioned design frame 501 and adhere to each of the inner surface 401*a* and the outer surface 401*b* of the fabric structure 401 in the pattern defined by the patterned holes 502 of the positioned design frame 501. In an embodiment, the gripping material 402 is selectively applied 203 on the inner surface 401*a* and/or the outer surface 401*b* of the fabric structure 401 directly without the design frame 501, for example, by one or more of painting, pouring, screen printing, heat pressing, spraying, heat-gluing, pressure gluing, heat-sealing, and selectively attaching, for example, by sewing, the gripping material 402 on selected areas on the inner surface 401*a* and/or the outer surface 401*b* of the fabric structure 401 in one or more of multiple patterns.

Figure 3:
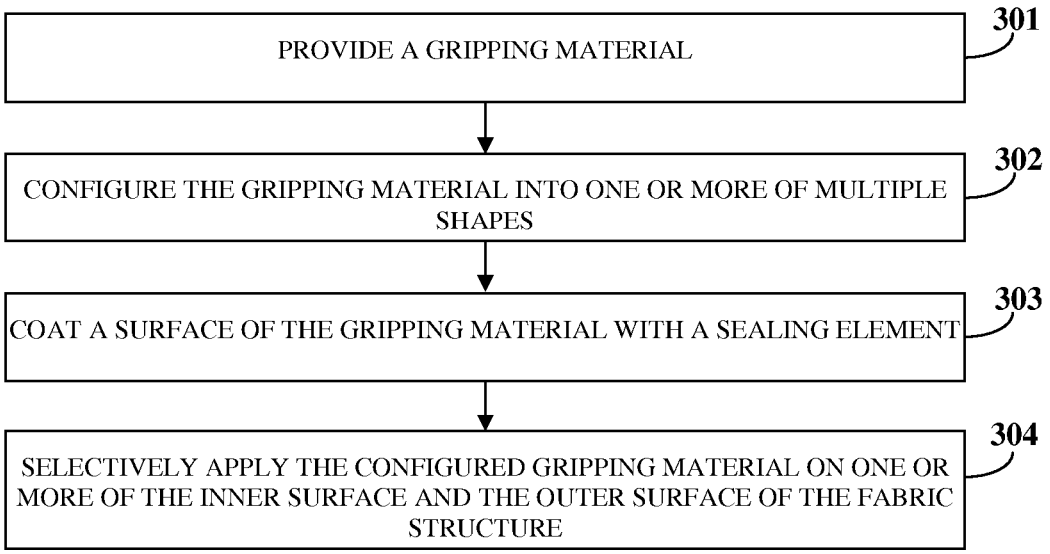
FIG. 3 exemplarily illustrates a method for selectively applying a gripping material on an inner surface and/or an outer surface of a fabric structure.
Figure 4A:
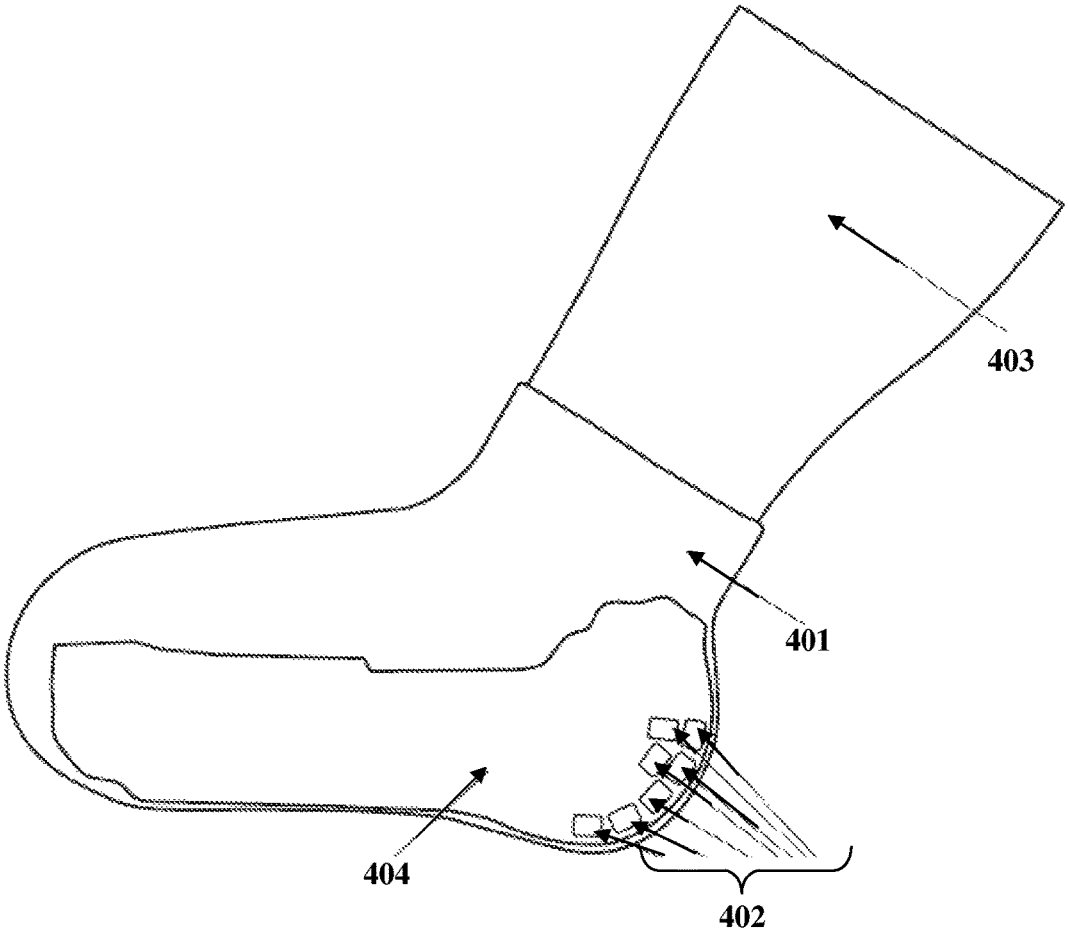
FIG. 4A exemplarily illustrates a fabric structure configured in the form of a sock stretched over a framework, showing a gripping material attached to a transfer material positioned on the sock for selectively applying the gripping material on the sock.
Figure 4B:
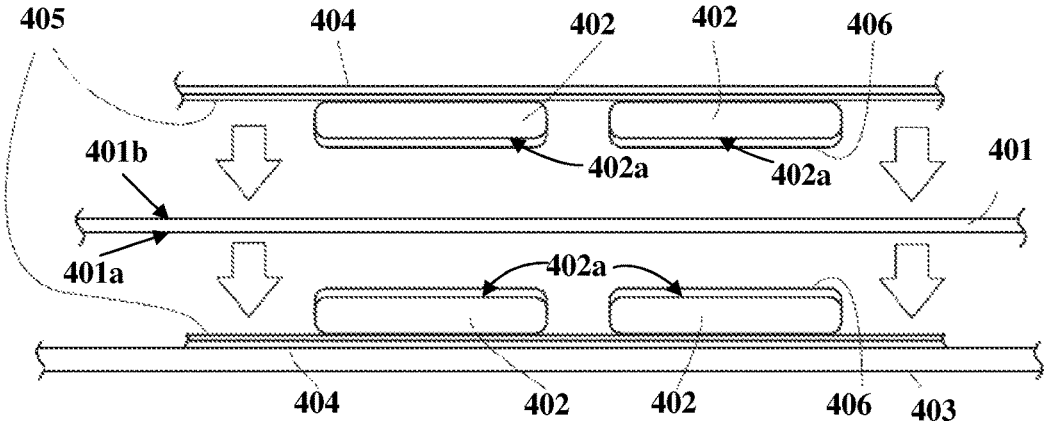
FIGS. 4B-4C exemplarily illustrate selective application of a gripping material on the sock using a heat press.
Figure 4C:
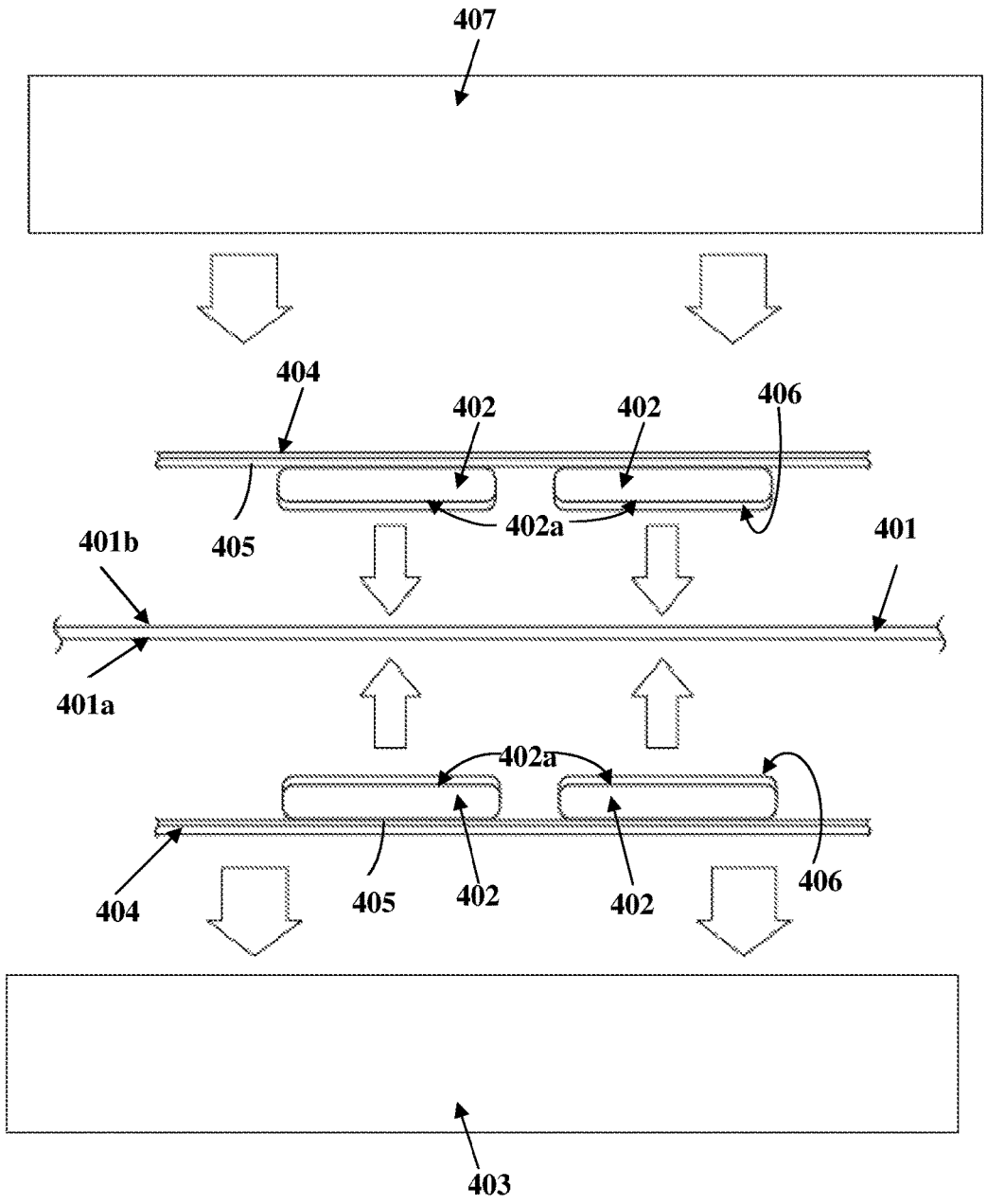

FIG. 3 exemplarily illustrates a method for selectively applying a gripping material 402 on an inner surface 401*a* and/or an outer surface 401*b* of a fabric structure 401 as shown in FIGS. 4A-4C. A gripping material 402, for example, a non-slip material, a tacky material, a textured material, etc., is provided 301. The gripping material 402 is configured 302 into one or more of multiple shapes. A surface of the gripping material 402 is coated 303 with a sealing element, for example, a heat seal adhesive 406 such as Bemis 3218 manufactured by Bemis Associates Inc., Massachusetts, USA, a fabric glue, a polyurethane heat seal, etc. The configured gripping material 402 is selectively applied 304 on the inner surface 401*a* and/or the outer surface 401*b* of the fabric structure 401, for example, by heat pressing as disclosed in the detailed description of FIGS. 4A-4C. The sealing element attaches the gripping material 402 to the inner surface 401*a* and/or the outer surface 401*b* of the fabric structure 401. The attached gripping material 402 on the inner surface 401*a* and/or the outer surface 401*b* of the fabric structure 401 adheres to the user contact surface and the external contact surface respectively, where the inner surface 401*a* of the fabric structure 401 is proximal to the user contact surface and distal to the external contact surface, and the outer surface 401*b* is proximal to the external contact surface and distal to the user contact surface. The adherence of the gripping material 402 on the inner surface 401*a* and the outer surface 401*b* of the fabric structure 401 to the user contact surface and the external contact surface respectively provides grip between the user contact surface and the fabric structure 401, and provides grip between the fabric structure 401 and the external contact surface.

FIG. 4A exemplarily illustrates a fabric structure 401 configured in the form of a sock stretched over a framework, showing a gripping material 402 attached to a transfer material 404 positioned on the sock for selectively applying the gripping material 402 on the sock. The fabric structure 401 comprising, for example, natural threads and/or synthetic threads is configured to conform to a user's body part, for example, a user's foot to construct a sock. The configured fabric structure 401 herein referred to as a "sock" and herein referenced by the numeral 401 is positioned over a framework, for example, a sock form 403. The sock form 403 is made, for example, of aluminum. The sock form 403 is a two-dimensional or three-dimensional framework that is configured in the shape of a sock 401. In an embodiment, the sock 401 is not positioned on the sock form 403 prior to selective application of the gripping material 402. The gripping material 402, for example, Clarino® blocks are attached to a transfer material 404, for example, made of paper, using a temporary adhesive 405 provided on the transfer material 404 as exemplarily illustrated in FIG. 4B. The temporary adhesive 405 holds the gripping material 402 in place until the gripping material 402 is heat pressed onto the sock 401 by using a heat press 407 as exemplarily illustrated in FIG. 4C. After the gripping material 402 is transferred to the inner surface 401*a* and the outer surface 401*b* of the sock 401, the transfer material 404 is peeled off from the sock 401, while retaining the gripping material 402 on the sock 401.

FIGS. 4B-4C exemplarily illustrate selective application of a gripping material 402 on the sock 401 using a heat press 407. A fabric structure 401 comprising, for natural threads and/or synthetic threads, that defines an inner surface 401*a* and an outer surface 401*b* is created. In this embodiment, the selective application of the gripping material 402 on the inner surface 401*a* and the outer surface 401*b* of the fabric structure 401 is performed, for example, by heat pressing for transferring the gripping material 402 to the inner surface 401*a* and the outer surface 401*b* of the fabric structure 401 in one or more of multiple patterns. Heat pressing is a method of applying heat and pressure on the fabric structure 401 for a predetermined period of time for transferring the gripping material 402 to the inner surface 401*a* and the outer surface 401*b* of the fabric structure 401. Heat pressing is performed using the heat press 407 as exemplarily illustrated in FIG. 4C.

The gripping material 402 is cut, for example, by laser cutting, die cutting, rotary cutting, etc., to a required specification and aligned on a transfer material 404. As exemplarily illustrated in FIGS. 4A-4B, the gripping material 402, for example, Clarino® blocks are attached to the transfer material 404 using a temporary adhesive 405. An opposing surface 402*a* of the gripping material 402 that faces the fabric structure 401 is coated, for example, with a polyurethane heat seal adhesive 406, for example, Bemis 3218 manufactured by Bemis Associates Inc. Bemis 3218 is a fully reacted elastomeric film that remains flexible over a wide temperature range. Bemis 3218 is a general purpose adhesive that combines a low activation temperature with a very high viscosity at its softening point.

The transfer material 404 that carries the gripping material 402 is positioned above and below the fabric structure 401 as exemplarily illustrated in FIGS. 4B-4C, with the gripping material 402 facing the outer surface 401*b* and the inner surface 401*a* of the fabric structure 401 respectively. The transfer material 404 with the gripping material 402 positioned below the fabric structure 401 rests on the sock form 403. Heat at a predetermined temperature, for example, about 375 degrees Fahrenheit (F) and pressure is applied on the transfer material 404 that carries the gripping material 402 above the fabric structure 401 for about 20 seconds using the heat press 407. The heat press 407 compresses the gripping material 402 towards the outer surface 401*b* and the inner surface 401*a* of fabric structure 401, resulting in the transfer of the gripping material 402 to the outer surface 401*b* and the inner surface 401*a* of the fabric structure 401. Due to the application of heat, the gripping material 402 peels off from the transfer material 404 and permanently bonds to the fabric structure 401. The transfer material 404 is thereafter removed from the fabric structure 401.

Figure 5A:
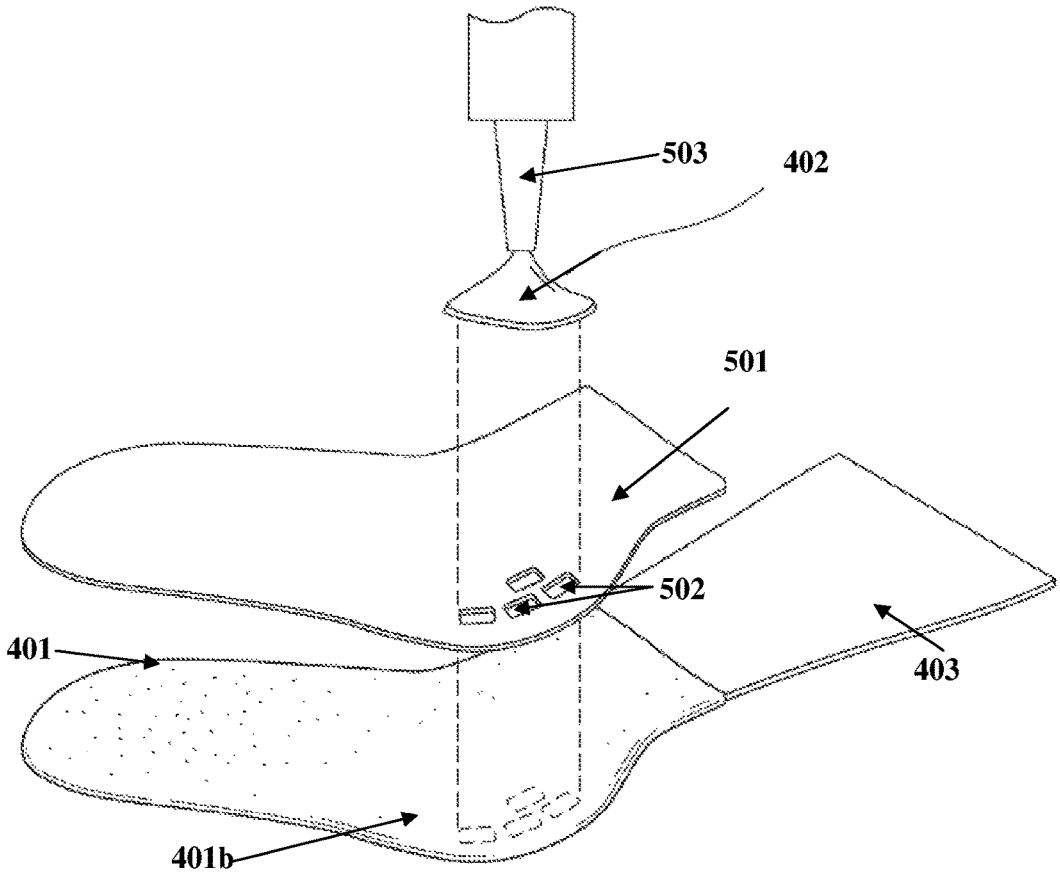
FIGS. 5A-5B exemplarily illustrate selective application of a gripping material on a fabric structure configured to conform to a user's body part, by pouring the gripping material on the configured fabric structure to construct a gripping garment.
Figure 5B:
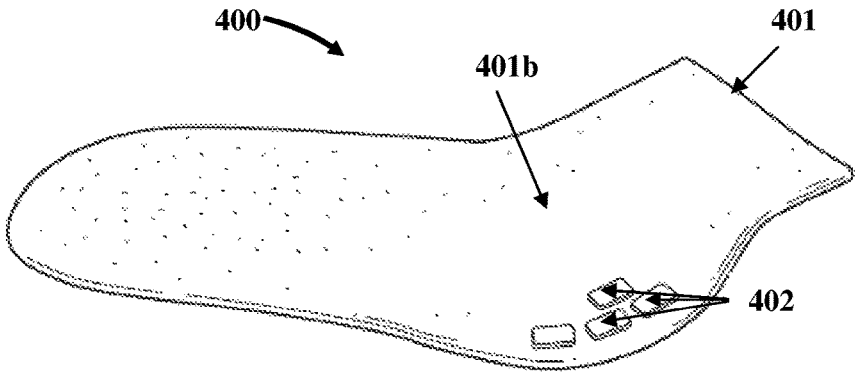

FIGS. 5A-5B exemplarily illustrate selective application of a gripping material 402 on a fabric structure 401 configured to conform to a user's body part, by pouring the gripping material 402 on the configured fabric structure 401 to construct a gripping garment 400. The fabric structure 401 is configured to conform to a user's body part, for example, the user's foot to construct a garment, for example, a sock. The configured fabric structure 401 is herein referred to as a "sock" and is herein referenced by the numeral 401. The threads of the fabric structure 401 are knitted, for example, using a circular knitting machine 1109 exemplarily illustrated in FIG. 11B, to construct the sock 401. The sock 401 is positioned over a framework, for example, a sock form 403 as disclosed in the detailed description of FIG. 4A. In this example, the selective application of the gripping material 402 on the outer surface 401*b* of the sock 401 is performed by pouring the gripping material 402 on the outer surface 401*b* of the sock 401 in one or more of multiple patterns as exemplarily illustrated in FIGS. 5A-5B. The gripping material 402 may also be selectively applied on the inner surface 401*a* of the sock 401 exemplarily illustrated in FIGS. 4B-4C by pouring the gripping material 402 on the inner surface 401*a* of the sock 401 in one or more of multiple patterns.

The design frame 501 comprising patterned holes 502 is created and positioned above the sock 401. The design frame 501 is, for example, a template, a stencil, a mask, etc. As exemplarily illustrated in FIG. 5A, the gripping material 402, for example, in a semi-liquid form is poured through the patterned holes 502 on the design frame 501 using a nozzle 503. The gripping material 402 passes through the patterned holes 502 of the design frame 501 and adheres to the outer surface 401*b* of the sock 401 in a pattern defined by the patterned holes 502 of the design frame 501 as exemplarily illustrated in FIG. 5A. The gripping material 402 then solidifies on the sock 401 as exemplarily illustrated in FIG. 5B. The sock 401 is then flipped inside out and repositioned over the sock form 403 prior to pouring the gripping material 402 through the patterned holes 502 on the design frame 501 positioned above the inner surface 401*a* of the sock 401. The gripping material 402 passes through the patterned holes 502 of the design frame 501 and adheres to the inner surface 401*a* of the sock 401 in a pattern defined by the patterned holes 502 of the design frame 501.

Figure 6A:
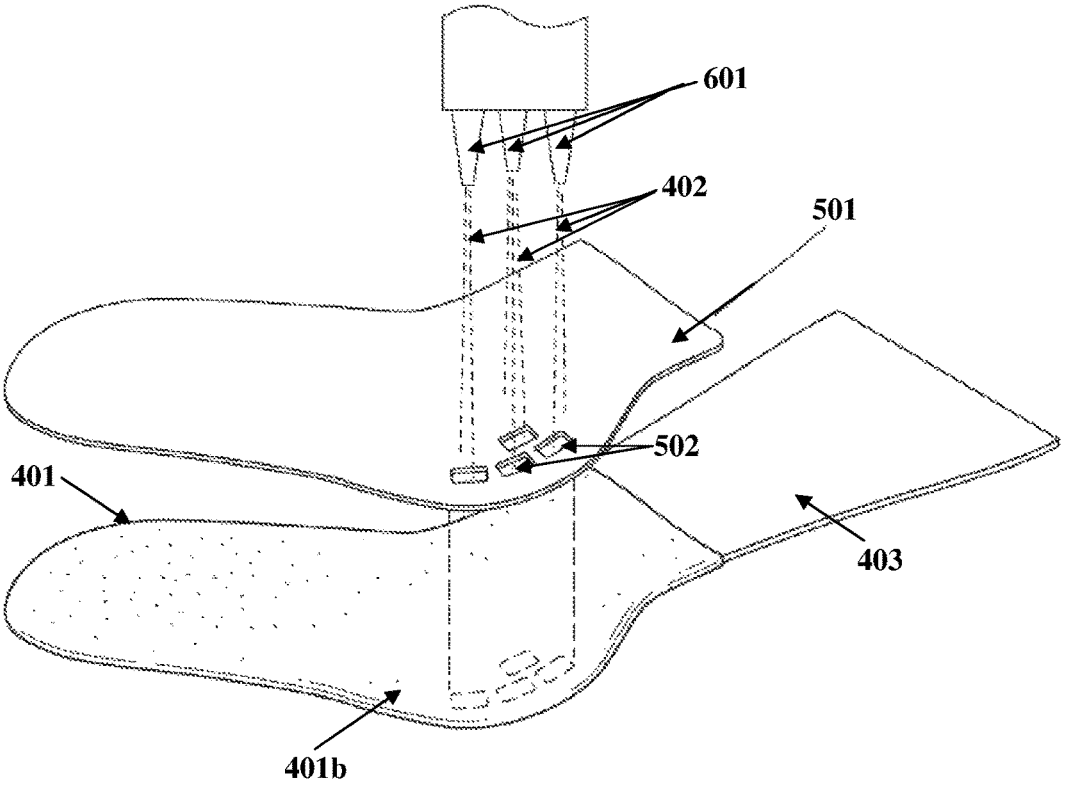
FIGS. 6A-6B exemplarily illustrate selective application of a gripping material on a fabric structure configured to conform to a user's body part, by spraying the gripping material on the configured fabric structure to construct a gripping garment.
Figure 6B:
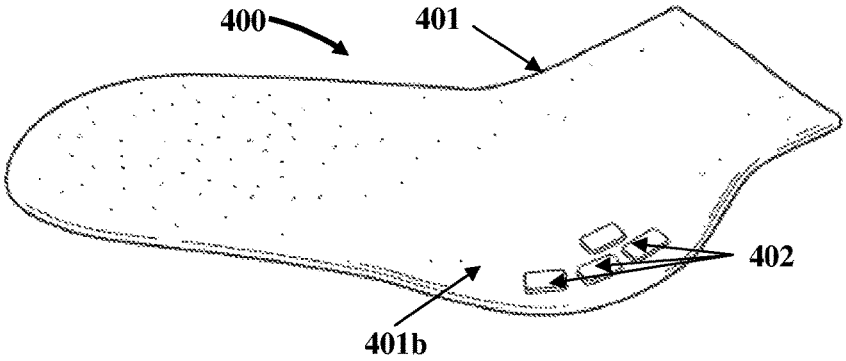

FIGS. 6A-6B exemplarily illustrate selective application of a gripping material 402 on a fabric structure 401 configured to conform to a user's body part, by spraying the gripping material 402 on the configured fabric structure 401 to construct a gripping garment 400. The fabric structure 401 is configured to conform to a user's body part, for example, the user's foot to construct a garment, for example, a sock. The configured fabric structure 401 is herein referred to as a "sock" and is herein referenced by the numeral 401. The threads of the fabric structure 401 are knitted, for example, using a circular knitting machine 1109 exemplarily illustrated in FIG. 11B, to construct the sock 401. The sock 401 is positioned over a framework, for example, a sock form 403 as disclosed in the detailed description of FIG. 4A. In this example, the selective application of the gripping material 402 on the outer surface 401*b* of the sock 401 is performed by spraying the gripping material 402 on the outer surface 401*b* of the sock 401 in one or more of multiple patterns as exemplarily illustrated in FIGS. 6A-6B. The gripping material 402 may also be selectively applied on the inner surface 401*a* of the sock 401 exemplarily illustrated in FIGS. 4B-4C, by spraying the gripping material 402 on the inner surface 401*a* of the sock 401 in one or more of multiple patterns.

The design frame 501 comprising patterned holes 502 is created and positioned above the sock 401. The design frame 501 is, for example, a template, a stencil, a mask, etc. As exemplarily illustrated in FIG. 6A, the gripping material 402, for example, in a liquid form is sprayed through the patterned holes 502 on the design frame 501 through a nozzle 601. The gripping material 402 passes through the patterned holes 502 of the positioned design frame 501 and adheres to the outer surface 401*b* of the sock 401 in a pattern defined by the patterned holes 502 of the design frame 501 as exemplarily illustrated in FIG. 6A. The gripping material 402 then solidifies on the sock 401 as exemplarily illustrated in FIG. 6B. The sock 401 is then flipped inside out and repositioned over the sock form 403 prior to spraying the gripping material 402 through the patterned holes 502 on the design frame 501 positioned above the inner surface 401*a* of the sock 401. The gripping material 402 passes through the patterned holes 502 of the design frame 501 and adheres to the inner surface 401*a* of the sock 401 in a pattern defined by the patterned holes 502 of the design frame 501. In an embodiment, the gripping material 402 is selectively applied on the inner surface 401*a* and/or the outer surface 401*b* of the sock 401 directly without the design frame 501, for example, by one or more of painting, pouring, screen printing, heat pressing, spraying, and selectively attaching, for example, by sewing the gripping material 402 on selected areas of the sock 401.

FIGS. 7A-7F exemplarily illustrate selectively attaching a gripping fabric configured as a patch 701 to a section of a garment to construct a gripping garment 400. In an embodiment, the gripping fabric constructed as disclosed in the detailed description of FIG. 1 is configured as a patch 701 and selectively attached, for example, by sewing to one or more sections of a garment, for example, a sock 401 as exemplarily illustrated in FIGS. 7A-7F. In an embodiment, the patch 701 is, for example, made of a gripping material 402, for example, a thermoplastic elastomer, a polyvinyl chloride, natural latex, synthetic latex, synthetic suede, suede leather, synthetic leather, other leathers, etc., instead of being made of a fabric structure 401 to which the gripping material 402 is coated. The patch 701 having an inner gripping surface 701*a* and an outer gripping surface 701*b* is selectively attached, for example, by sewing to one or more sections of the sock 401 for providing grip between a user contact surface and the sock 401, and for providing grip between the sock 401 and an external contact surface. The selectively attached patch 701 contacts both the user contact surface and the external contact surface simultaneously.

Figure 7A:
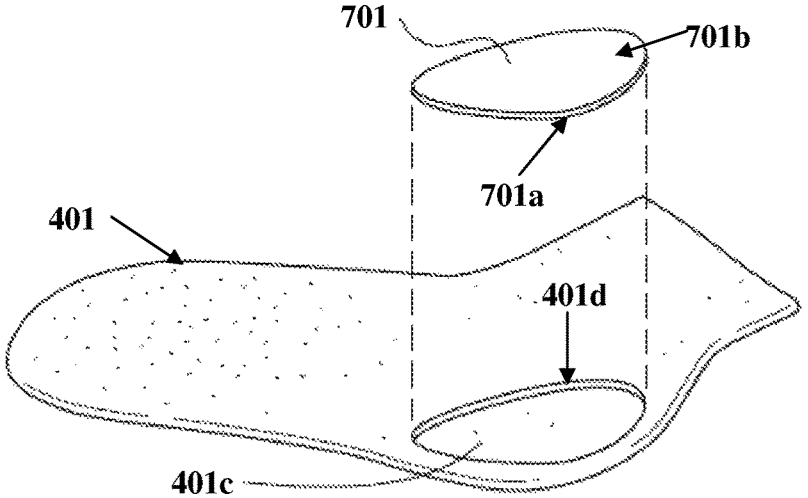
FIGS. 7A-7F exemplarily illustrate selectively attaching a gripping fabric configured as a patch to a section of a garment to construct a gripping garment.
Figure 7B:
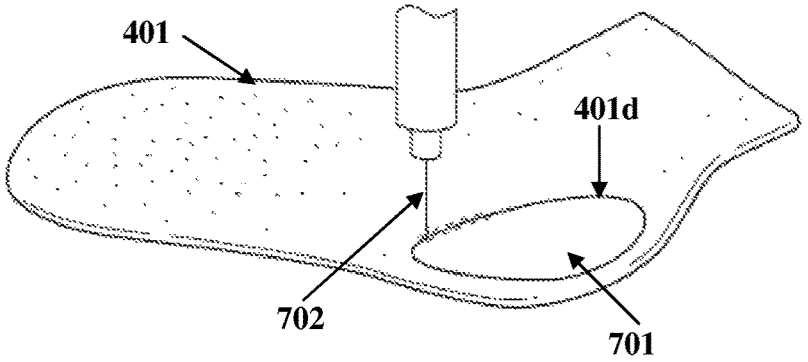
Figure 7C:
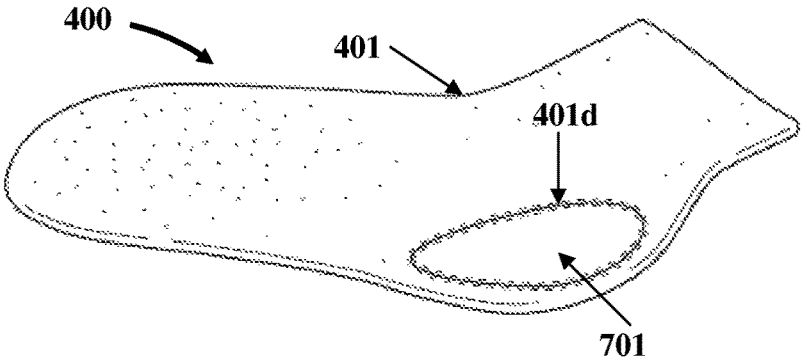
Figure 7D:
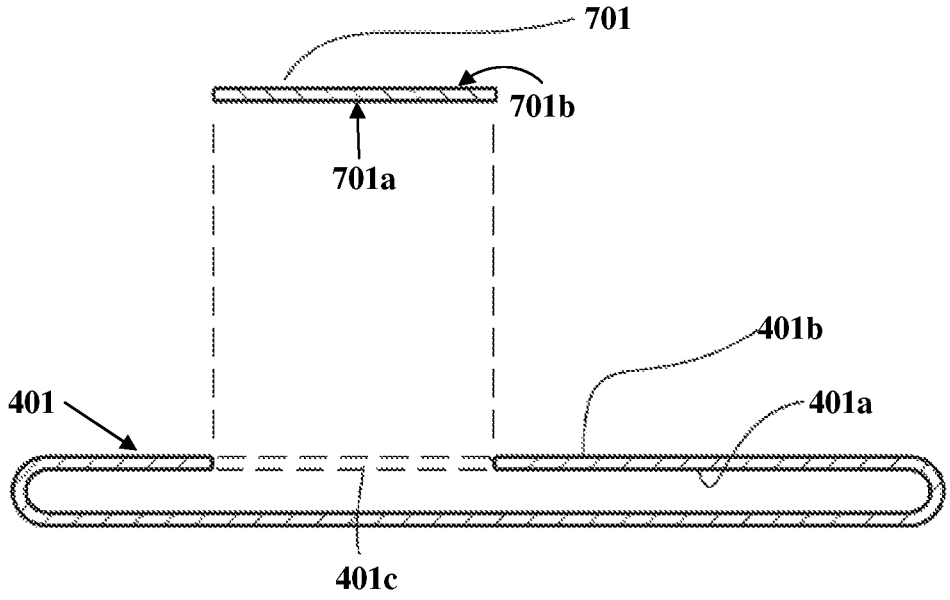
Figure 7E:
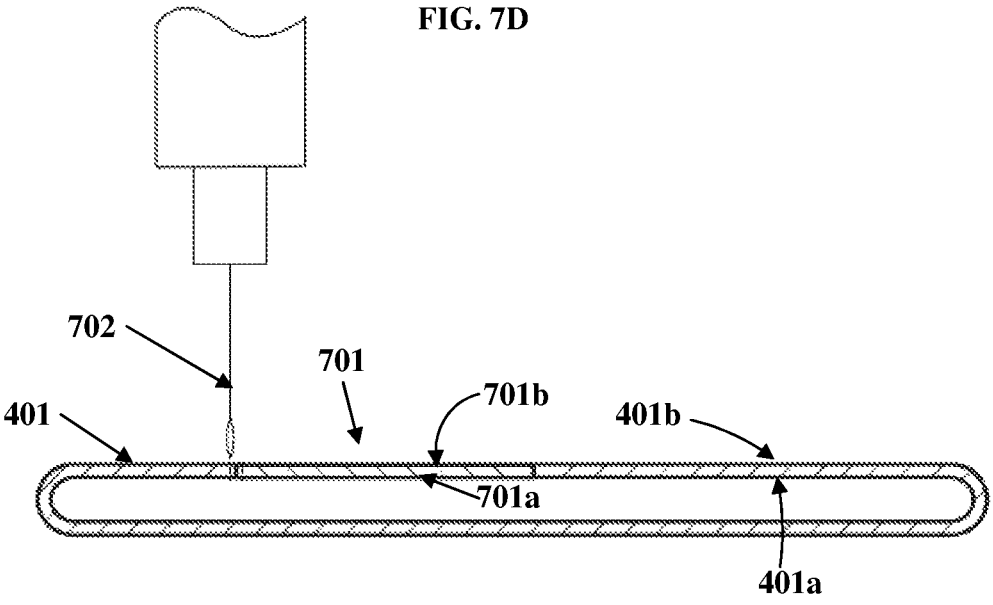
Figure 7F:
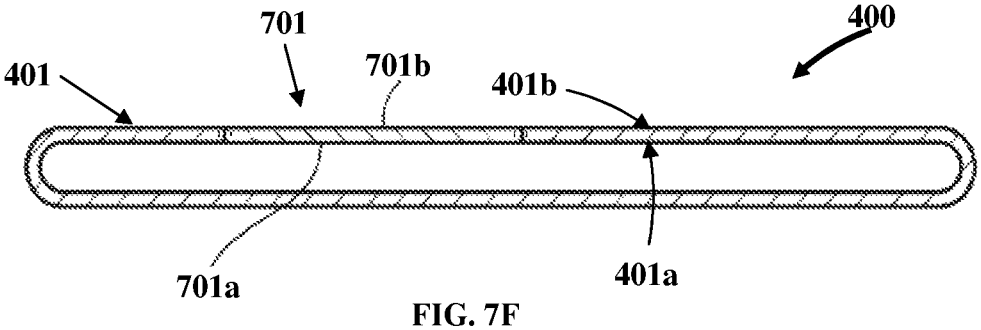

As exemplarily illustrated in FIG. 7A and FIG. 7D, an opening 401*c* is defined in the sock 401. The patch 701 having the gripping surfaces 701*a* and 701*b* is then targeted towards the opening 401*c* as exemplarily illustrated in FIG. 7A and FIG. 7D, and sewn along the edge 401*d* of the opening 401*c*, for example, using a sewing needle 702 as exemplarily illustrated in FIG. 7B and FIG. 7E, to cover the opening 401*c* in the sock 401, thereby constructing a gripping garment 400, that is, a gripping sock as exemplarily illustrated in FIG. 7C and FIG. 7F. The sewn patch 701 having the gripping surfaces 701*a* and 701*b* on a section of the gripping garment 400 provides a selective grip, for example, to the heel of the user's foot between the user's heel and the patch 701 and simultaneously provides grip, that is, traction between the patch 701 and footwear worn by the user.

Figure 7G:
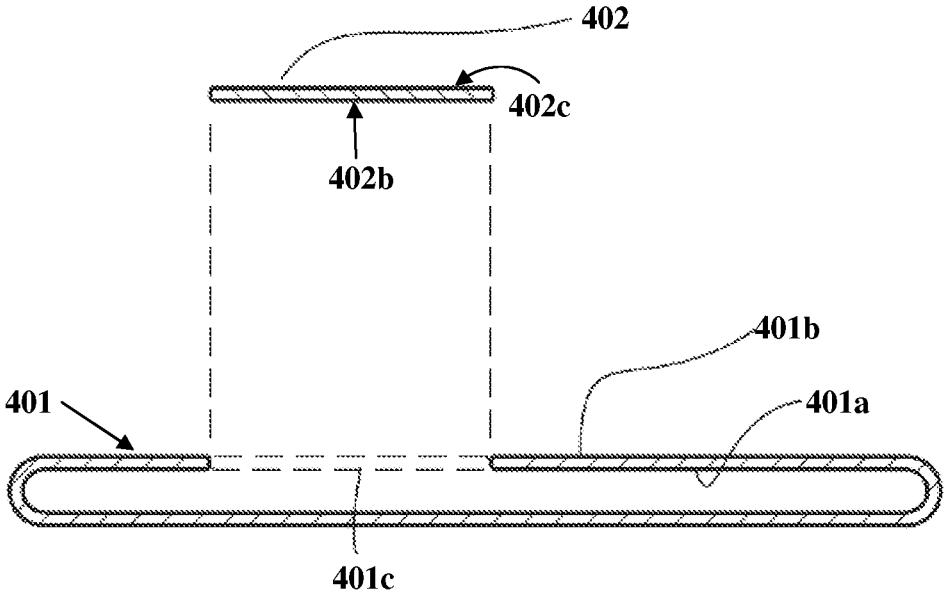
FIGS. 7G-7I exemplarily illustrate selectively attaching a gripping material to a section of a fabric structure configured to conform to a user's body part to construct a gripping garment.
Figure 7H:
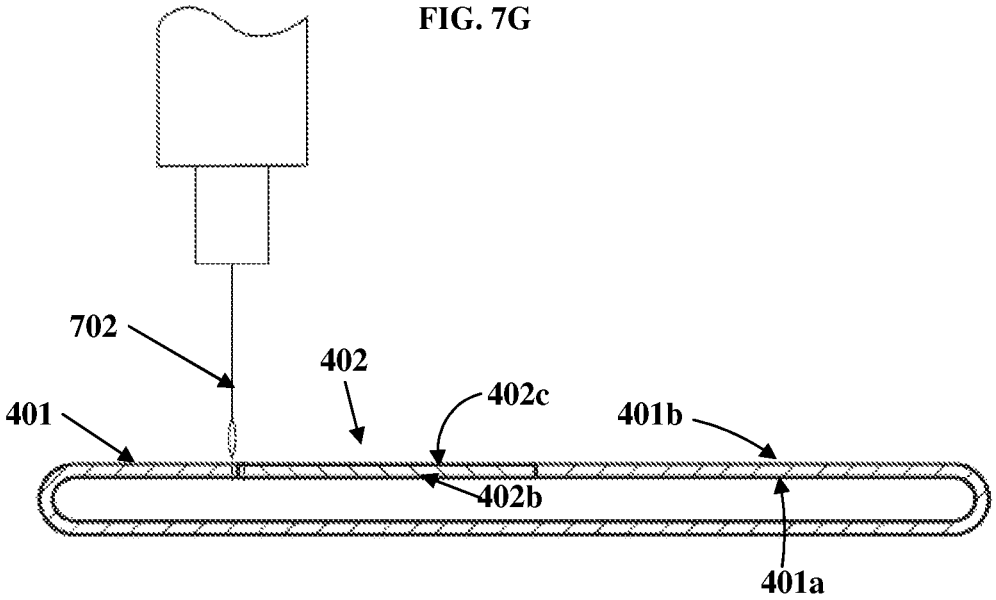
Figure 7I:
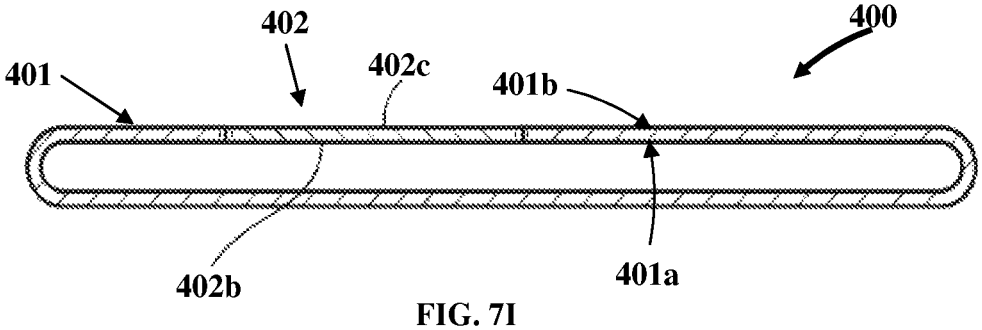

FIGS. 7G-7I exemplarily illustrate selectively attaching a gripping material 402 to a section of a fabric structure 401 configured to conform to a user's body part to construct a gripping garment 400. In an embodiment, a gripping material 402, for example, natural leather or synthetic leather, having an inner gripping surface 402*b* and an outer gripping surface 402*c* is selectively attached, for example, by sewing, heat pressing, etc., to one or more sections on the inner surface 401*a* and the outer surface 401*b* of the configured fabric structure 401, for example, a sock, a glove, etc., for providing gripping properties, blister prevention properties, etc., to the configured fabric structure 401. The resulting gripping garment 400 will therefore have a smooth leather finish. In another example, gripping materials, for example, polyvinyl chloride, thermoplastic elastomers, natural latex rubber, Clarino®, etc., are selectively applied, for example, by sewing, heat pressing, etc., to one or more sections on the inner surface 401*a* and the outer surface 401*b* of the configured fabric structure 401, for example, a sock, a glove, etc., for providing gripping properties, blister prevention properties, etc., to the configured fabric structure 401.

In an embodiment as exemplarily illustrated in FIG. 7G, an opening 401*c* is defined in the configured fabric structure 401. The gripping material 402 having the gripping surfaces 402*b* and 402*c* is then targeted towards the opening 401*c* as exemplarily illustrated in FIG. 7G, and sewn along the opening 401*c*, for example, using a sewing needle 702 as exemplarily illustrated in FIG. 7H, to cover the opening 401*c* in the configured fabric structure 401, thereby constructing a gripping garment 400, that is, a gripping sock, a gripping glove, etc., as exemplarily illustrated in FIG. 7I. The sewn gripping material 402 having the gripping surfaces 402*b* and 402*c* on a section of the gripping garment 400 provides a grip to the user's body part between the user's body part and the sewn gripping material 402 and simultaneously provides grip, that is, traction between the sewn gripping material 402 and an external contact surface.

FIGS. 8A-8D exemplarily illustrate selectively attaching a gripping material 402 to a fabric structure 401 configured to conform to a user's body part, for example, a user's foot to construct a gripping garment 400, for example, a gripping sock. The configured fabric structure 401 is herein referred to as a "sock" and is herein referenced by the numeral 401. The threads of the fabric structure 401 are knitted, for example, using a circular knitting machine 1109 exemplarily illustrated in FIG. 11B, to construct the sock 401. The gripping material 402 is configured into one or more of multiple shapes, as exemplarily illustrated in FIG. 8A, for selective application or attachment of the gripping material 402 on the inner surface 401*a* and/or the outer surface 401*b* of the sock 401. In this embodiment, the gripping material 402 itself is selectively attached in one or more of multiple patterns to one or more sections of the sock 401 for providing grip between the user contact surface and the sock 401, and for providing grip between the sock 401 and the external contact surface.

Figure 8A:
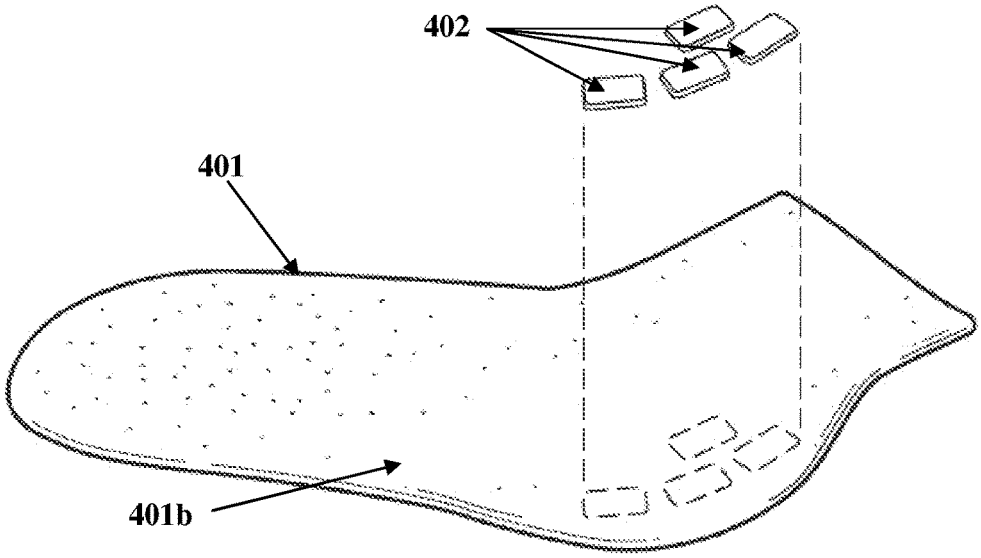
FIGS. 8A-8D exemplarily illustrate selectively attaching a gripping material to a fabric structure configured to conform to a user's body part to construct a gripping garment.
Figure 8B:
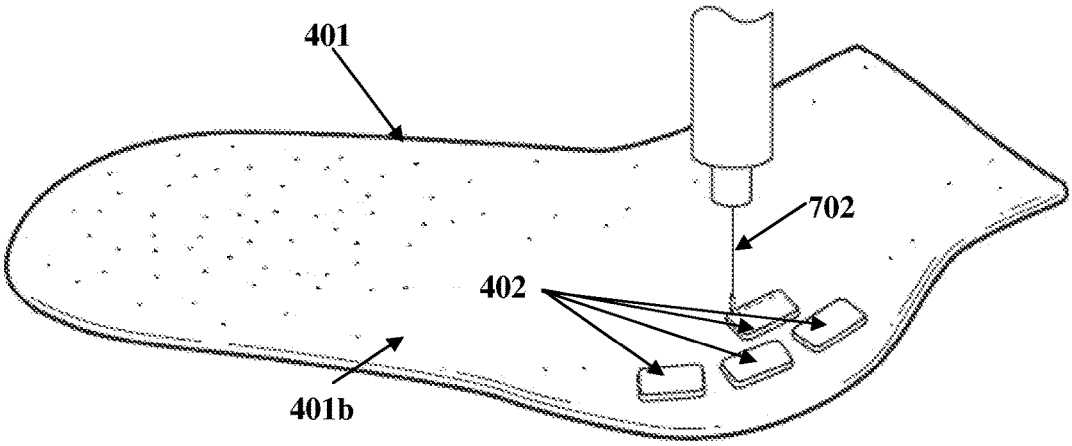
Figure 8C:
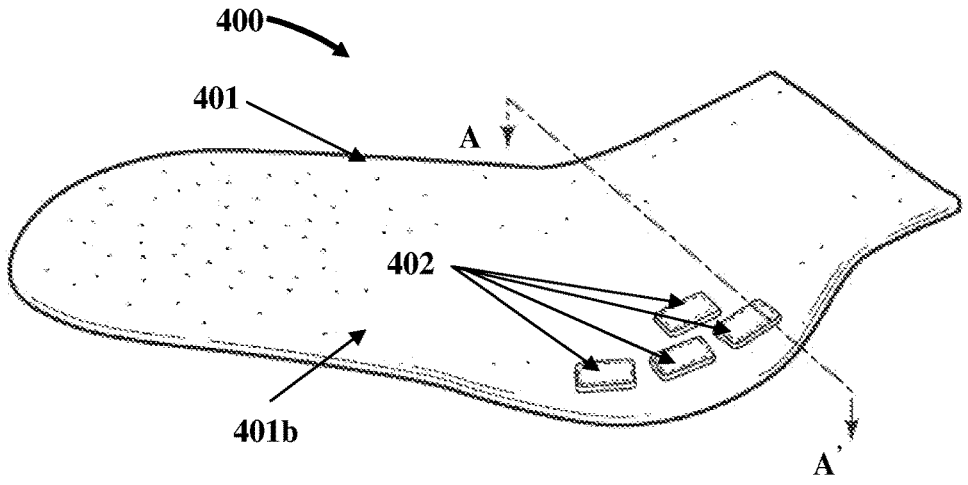
Figure 8D:
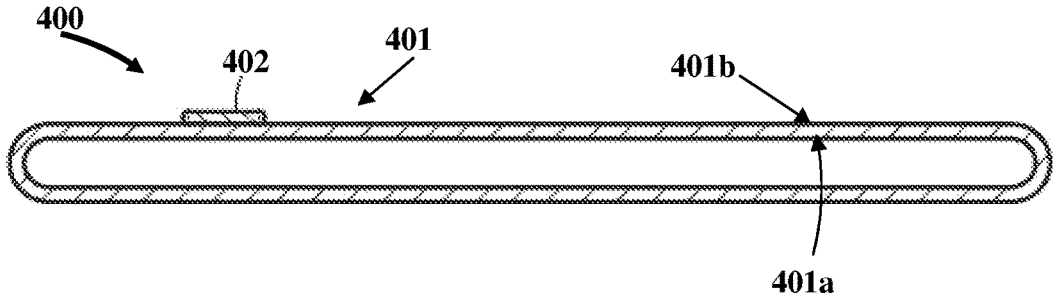

As exemplarily illustrated in FIG. 8B, the gripping material 402 is sewn on the outer surface 401*b* of the sock 401, for example, using a sewing needle 702 to construct the gripping garment 400 as exemplarily illustrated in FIG. 8C. A sectional view of the gripping garment 400 having the attached gripping material 402, taken along the line A-A' in FIG. 8C is exemplarily illustrated in FIG. 8D. In this embodiment, the fabric structure 401 configured to conform to a user's body part, for example, the user's foot, does not have one or more openings 401*c* that are to be filled in by a patch 701 as exemplarily illustrated in FIGS. 7A-7F or filled in by the gripping material 402 as exemplarily illustrated in FIGS. 7G-7I. The gripping material 402 is disposed over the sock 401 in one or more of multiple patterns on the inner surface 401*a* and/or the outer surface 401*b* of the sock 401 and sewn thereon to construct the gripping garment 400 as exemplarily illustrated in FIGS. 8C-8D.

Figure 9:
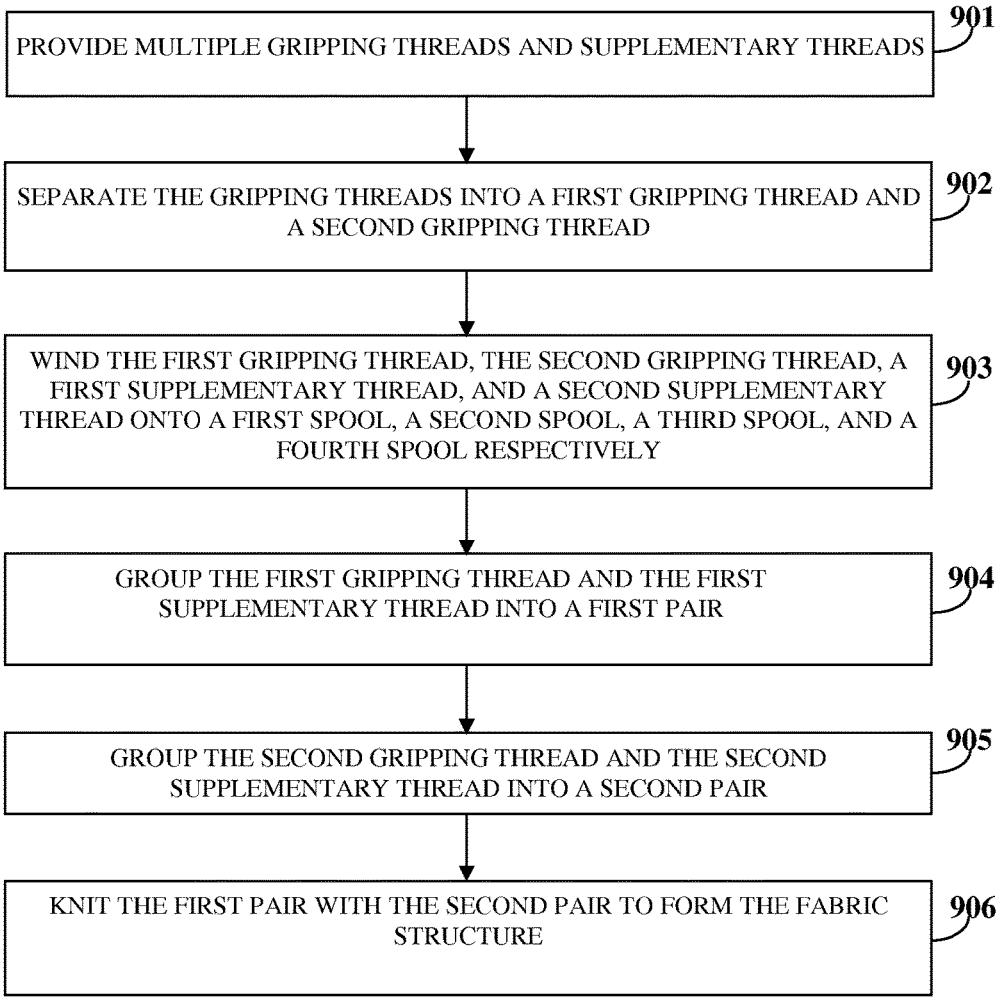
FIG. 9 exemplarily illustrates an embodiment for creating a fabric structure as shown in FIGS. 13A-13B.
Figure 13A:
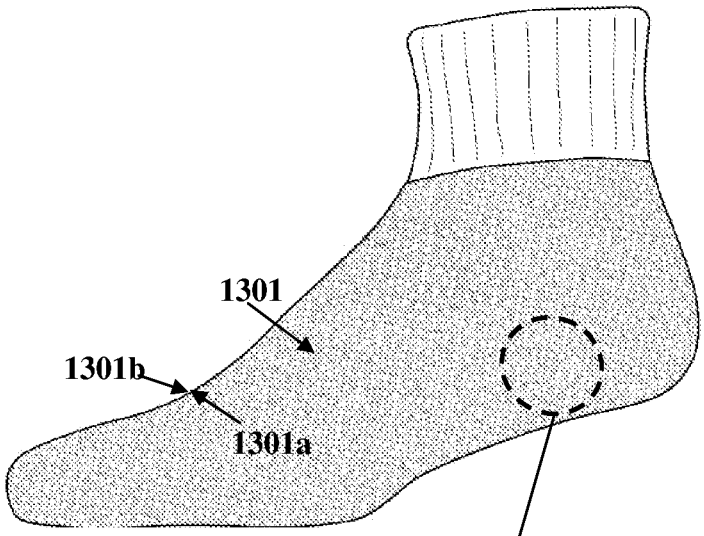
FIG. 13A exemplarily illustrates a fabric structure configured to conform to a user's body part.
Figure 13B:
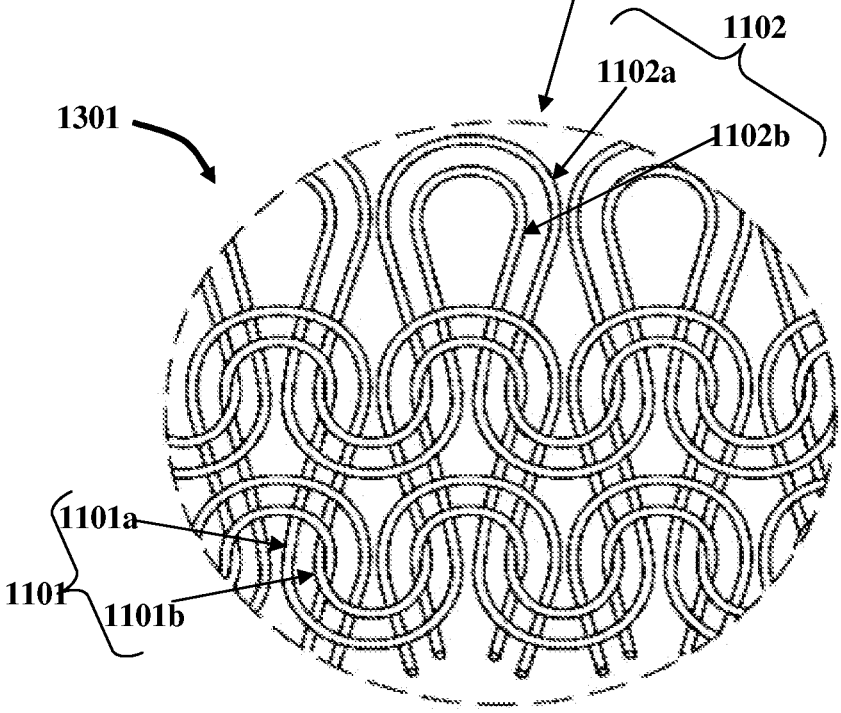
FIG. 13B exemplarily illustrates an enlarged sectional view of the fabric structure.
Figure 14A:
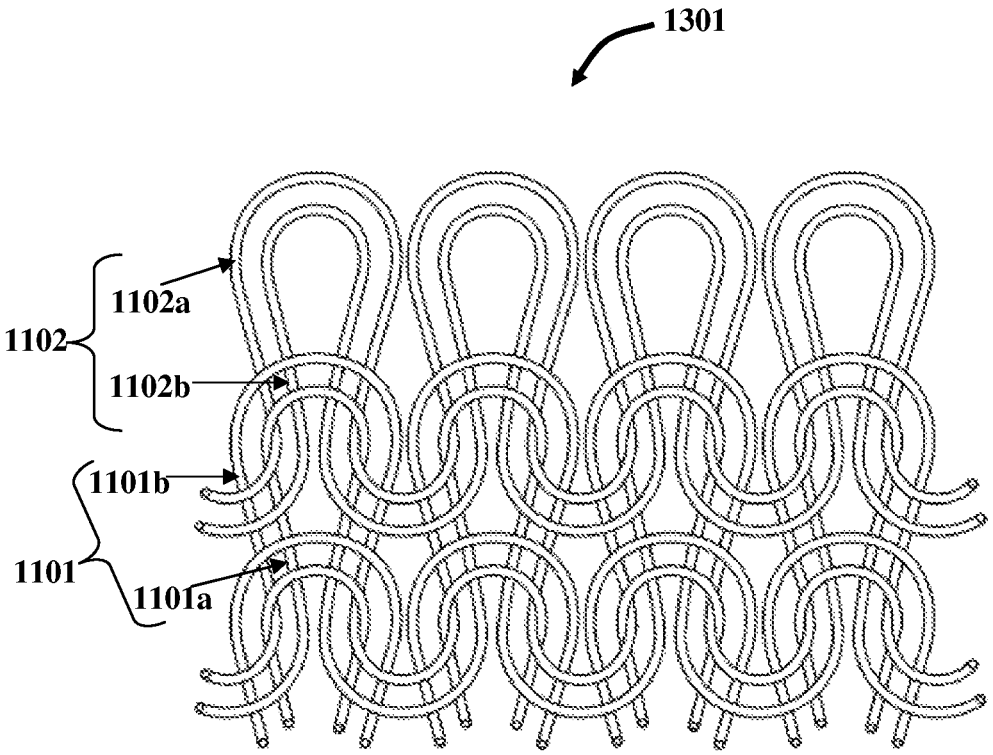
FIGS. 14A-14D exemplarily illustrate multiple views of the fabric structure of FIGS. 13A-13B, showing a first pair comprising a first gripping thread and a first supplementary thread knitted with a second pair comprising a second gripping thread and a second supplementary thread for creating the fabric structure.
Figure 14B:
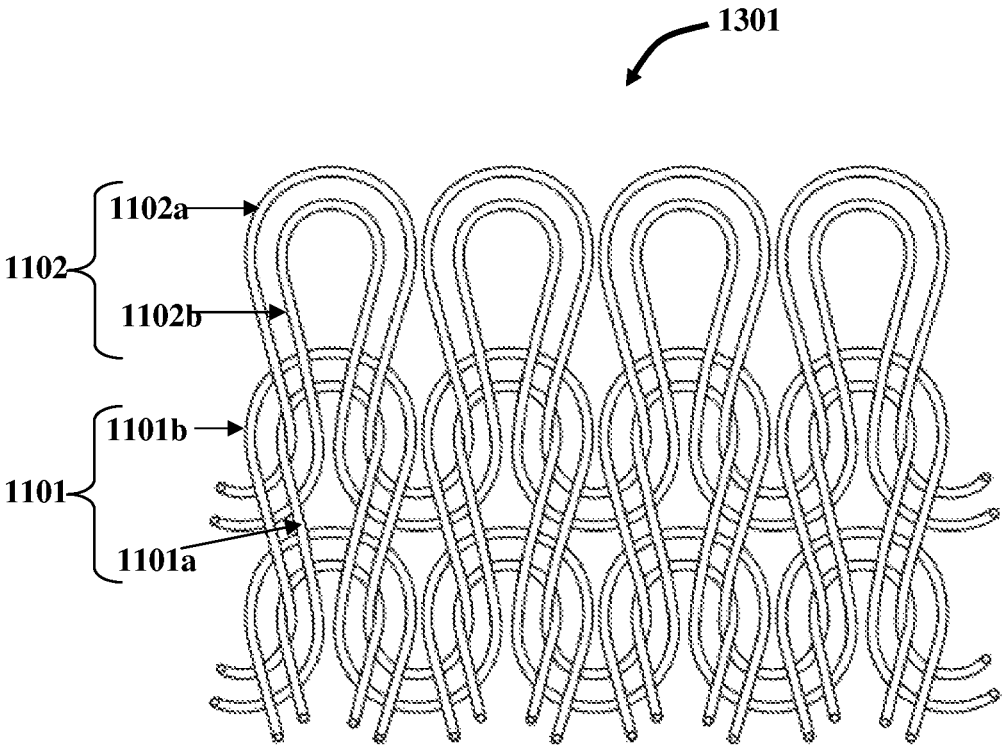
Figure 14C:
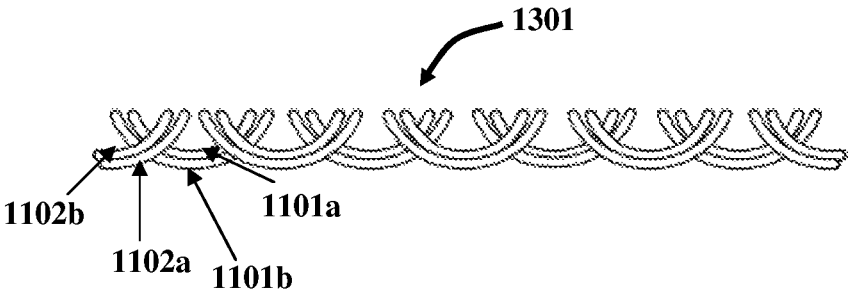
Figure 14D:
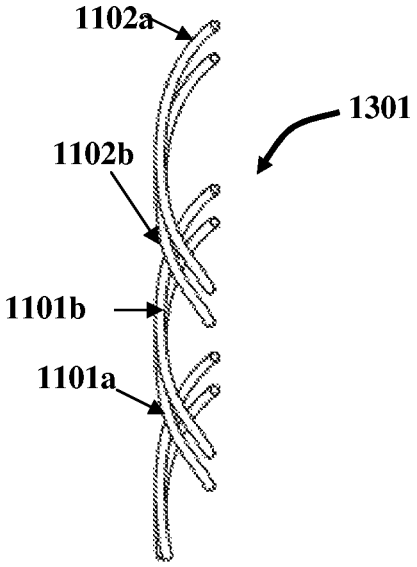

FIG. 9 exemplarily illustrates an embodiment for creating a fabric structure 1301 as shown in FIGS. 13A-13B. Multiple gripping threads 1101*a* and 1102*a* and supplementary threads 1101*b* and 1102*b* as exemplarily illustrated in FIGS. 11A-11B, FIG. 13B, and FIGS. 14A-14D are provided 901. As used herein, the "gripping threads" refer to non-slip, sticky, tacky, and/or textured threads that exhibit generally high surface adhesion and provide grip between the user contact surface and a fabric structure 1301 made from the gripping threads 1101*a* and 1102*a*, and simultaneously provide grip between the fabric structure 1301 and the external contact surface. The gripping threads 1101*a* and 1102*a* are coated with an anti-adhesive material, for example, silicon, talcum powder, etc., to prevent gathering and tangling in machinery. The gripping threads 1101*a* and 1102*a* used for creating the fabric structure 1301 are made from non-slip materials, tacky materials, and/or textured materials comprising, for example, one or more of synthetic rubber, natural latex, polyvinyl chloride, plastisol, thermoplastic rubber, thermoplastic elastomers, polyurethane, thermoplastic coatings on conventional threads, etc.

Also, as used herein, the term "supplementary thread" refers to an additional thread made from a conventional material, for example, cotton, nylon, polyester, wool, etc., which is knitted along with a gripping thread 1101*a* or 1102*a* to create a first pair 1101 or a second pair 1102 as disclosed herein. The supplementary threads 1101*b* and 1102*b* are selected from materials comprising, for example, cotton, nylon, polyester, spandex such as Lycra®, wool, etc. The gripping threads 1101*a* and 1102*a* are separated 902 into a first gripping thread 1101*a* and a second gripping thread 1102*a*. The first gripping thread 1101*a*, the second gripping thread 1102*a*, a first supplementary thread 1101*b*, and a second supplementary thread 1102*b* are wound 903 onto a first spool 1104*a*, a second spool 1104*b*, a third spool 1104*c*, and a fourth spool 1104*d* respectively. The first gripping thread 1101*a* and the first supplementary thread 1101*b* are grouped 904 into a first pair 1101. The second gripping thread 1102*a* and the second supplementary thread 1102*b* are grouped 905 into a second pair 1102.

The first pair 1101 is knitted 906 with the second pair 1102 to form the fabric structure 1301. The first pair 1101 defines the inner surface 1301*a* of the fabric structure 1301. The second pair 1102 defines the outer surface 1301*b* of the fabric structure 1301. The first gripping thread 1101*a* of the first pair 1101 is exposed on the inner surface 1301*a* of the fabric structure 1301 but not exposed on the outer surface 1301*b* of the fabric structure 1301. The second gripping thread 1102*a* of the second pair 1102 is exposed on the outer surface 1301*b* of the fabric structure 1301 but not exposed on the inner surface 1301*a* of the fabric structure 1301. The inner surface 1301*a* defined by the first pair 1101 provides grip between the user contact surface and the fabric structure 1301. The outer surface 1301*b* defined by the second pair 1102 provides grip between the fabric structure 1301 and the external contact surface. The gripping threads 1101*a* and 1102*a* can also be placed only in certain selective areas on the inner surface 1301*a* and/or the outer surface 1301*b* of the fabric structure 1301. Additionally, the fabric structure 1301 can be created without the use of the conventional supplementary thread 1101*b* or 1102*b*, but rather the gripping threads 1101*a* and 1102*a* are used exclusively to create the inner surface 1301*a* and the outer surface 1301*b* of the fabric structure 1301, or selective areas or portions of the fabric structure 1301, for example, a heel section that accommodates the user's heel, a ball section that accommodates the ball of the user's foot, etc.

Figure 10:
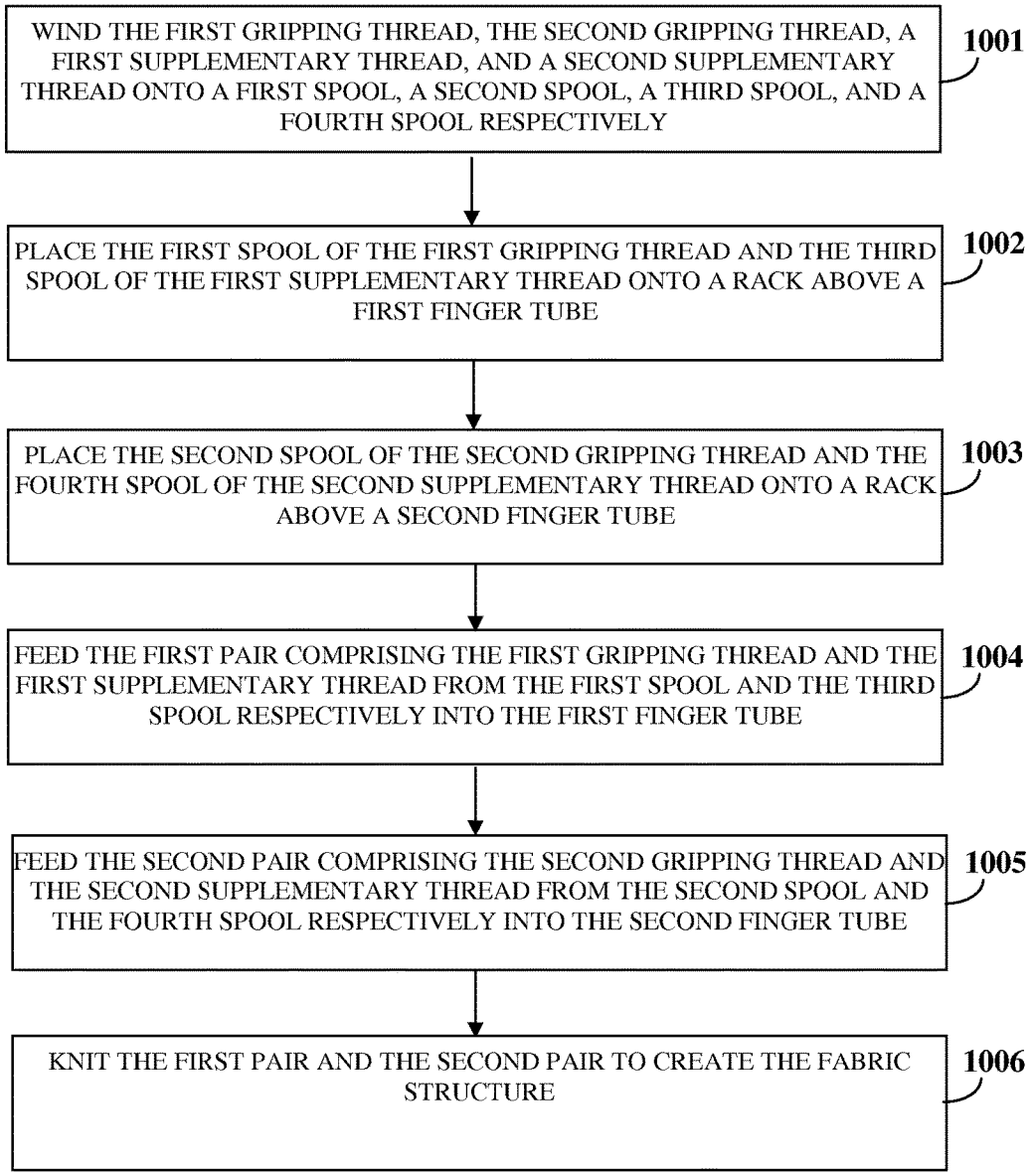
FIG. 10 exemplarily illustrates an embodiment for creating an inner surface and an outer surface of the fabric structure shown in FIGS. 13A-13B.
Figure 11A:
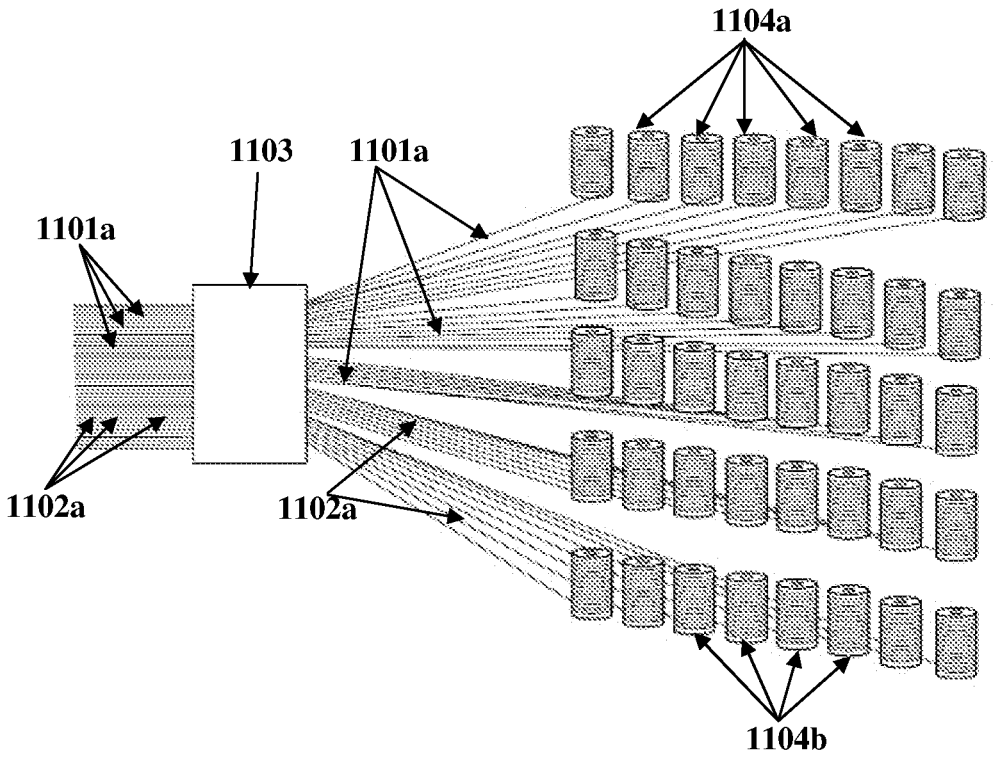
FIGS. 11A-11B exemplarily illustrate knitting of a first pair comprising a first gripping thread and a first supplementary thread with a second pair comprising a second gripping thread and a second supplementary thread for creating the fabric structure shown in FIG. 13B.
Figure 11B:
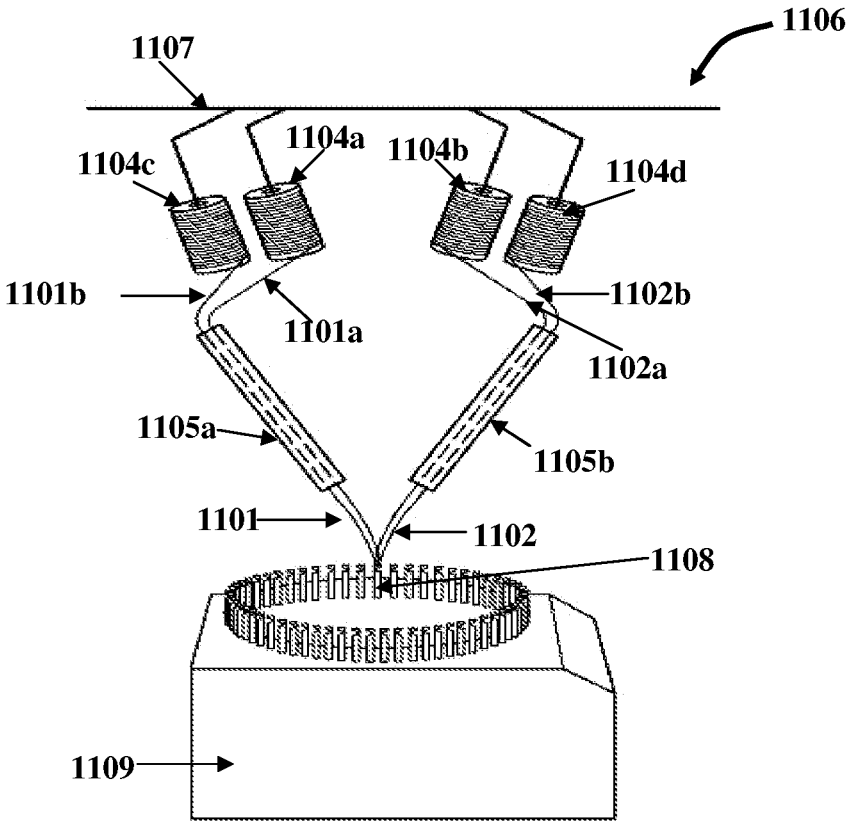

FIG. 10 exemplarily illustrates an embodiment for creating an inner and outer surface 1301*b* of the fabric structure 1301 shown in FIGS. 13A-13B. Consider an example where the first gripping thread 1101*a*, the second gripping thread 1102*a*, a first supplementary thread 1101*b*, and a second supplementary thread 1102*b*, as exemplarily illustrated in FIGS. 11A-11B, are wound 1001 onto a first spool 1104*a*, a second spool 1104*b*, a third spool 1104*c*, and a fourth spool 1104*d* respectively. The first spool 1104*a* of the first gripping thread 1101*a* and the third spool 1104*c* of the first supplementary thread 1101*b* are placed 1002 onto a rack 1107 positioned on a knitting unit 1106 above a first finger tube 1105*a* as exemplarily illustrated in FIG. 11B. The second spool 1104*b* of the second gripping thread 1102*a* and the fourth spool 1104*d* of the second supplementary thread 1102*b* are placed 1003 onto the rack 1107 positioned on the knitting unit 1106 above a second finger tube 1105*b* as exemplarily illustrated in FIG. 11B.

A first pair 1101 comprising the first gripping thread 1101*a* and the first supplementary thread 1101*b* from the first spool 1104*a* and the third spool 1104*c* respectively is fed 1004 into a first finger tube 1105*a*, while the second pair 1102 comprising the second gripping thread 1102*a* and the second supplementary thread 1102*b* from the second spool 1104*b* and the fourth spool 1104*d* respectively is fed 1005 into a second finger tube 1105*b*. The first pair 1101 and the second pair 1102 are retrieved from the first finger tube 1105*a* and the second finger tube 1105*b* respectively and knitted 1006, for example, using a latch needle 1108 of a knitting machine 1109, as exemplarily illustrated in FIG. 11C, for creating the fabric structure 1301 as exemplarily illustrated in FIG. 13B. The knitting machine 1109 is, for example, a Lonati 454 machine, Lonati Co., Brescia, Italy.

FIGS. 11A-11B exemplarily illustrate knitting of a first pair 1101 comprising a first gripping thread 1101*a* and a first supplementary thread 1101*b* with a second pair 1102 comprising a second gripping thread 1102*a* and a second supplementary thread 1102*b* for creating the fabric structure 1301 shown in FIG. 13B. The gripping threads 1101*a* and 1102*a* are separated out of a box into a first gripping thread 1101*a* and a second gripping thread 1102*a*. FIG. 11A exemplarily illustrates multiple gripping threads 1101*a* and 1102*a* being separated and wound around spools 1104*a* and 1104*b* respectively. The gripping threads 1101*a* and 1102*a* are separated into separate spools, for example, 1104*a* and 1104*b* of gripping threads 1101*a* and 1102*a* respectively using a twisting machine 1103. Consider an example where the first gripping thread 1101*a*, the second gripping thread 1102*a*, a first supplementary thread 1101*b*, and a second supplementary thread 1102*b* are wound onto a first spool 1104*a*, a second spool 1104*b*, a third spool 1104*c*, and a fourth spool 1104*d* respectively. The first spool 1104*a* of the first gripping thread 1101*a* and the third spool 1104*c* of the first supplementary thread 1101*b* are placed onto a rack 1107 positioned on a knitting unit 1106 above a first finger tube 1105*a* as exemplarily illustrated in FIG. 11B. The second spool 1104*b* of the second gripping thread 1102*a* and the fourth spool 1104*d* of the second supplementary thread 1102*b* are placed onto the rack 1107 positioned on the knitting unit 1106 above a second finger tube 1105*b* as exemplarily illustrated in FIG. 11B.

To create the inner surface 1301*a* of the fabric structure 1301, the first gripping thread 1101*a* and the first supplementary thread 1101*b* from the first spool 1104*a* and the third spool 1104*c* respectively are simultaneously fed into the first finger tube 1105*a* as exemplarily illustrated in FIG. 11B. The first gripping thread 1101*a* and the first supplementary thread 1101*b* are grouped into a first pair 1101 that defines the inner surface 1301*a* of the fabric structure 1301 exemplarily illustrated in FIGS. 13A-13B. To create the outer surface 1301*b* of the fabric structure 1301, the second gripping thread 1102*a* and the second supplementary thread 1102*b* from the second spool 1104*b* and the fourth spool 1104*d* respectively are fed simultaneously into the second finger tube 1105*b* as exemplarily illustrated in FIG. 11B. The second gripping thread 1102*a* and the second supplementary thread 1102*b* are grouped into a second pair 1102 that defines the outer surface 1301*b* of the fabric structure 1301 exemplarily illustrated in FIGS. 13A-13B.

The first pair 1101 is knitted with the second pair 1102 to form the fabric structure 1301 using one or more of multiple latch needles 1108 in a circular knitting machine 1109 as exemplarily illustrated in FIG. 11B. The technique of knitting one or more pairs 1101 of threads 1101*a* and 1101*b* to define the inner surface 1301*a* of the fabric structure 1301 and one or more pairs 1102 of the same or different material threads 1102*a* and 1102*b* to define the outer surface 1301*b* of the fabric structure 1301 is known as plating. The first gripping thread 1101*a* of the first pair 1101 is exposed on the inner surface 1301*a* of the fabric structure 1301. The first gripping thread 1101*a* of the first pair 1101 is not exposed on the outer surface 1301*b* of the fabric structure 1301. The second gripping thread 1102*a* of the second pair 1102 is exposed on the outer surface 1301*b* of the fabric structure 1301. The second gripping thread 1102*a* of the second pair 1102 is not exposed on the inner surface 1301*a* of the fabric structure 1301.

Figure 11C:
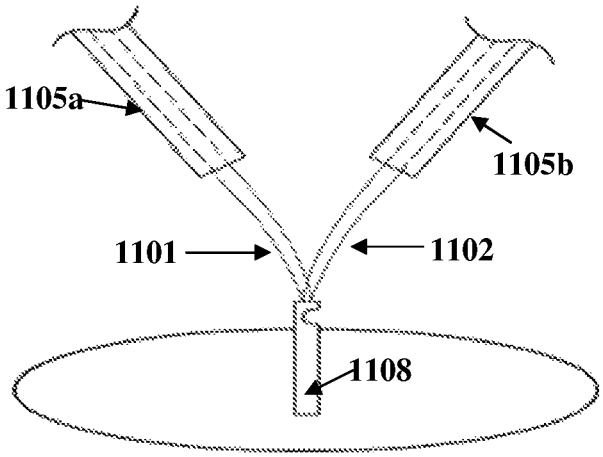
FIG. 11C exemplarily illustrates knitting the first pair and the second pair using a latch needle for creating the fabric structure shown in FIGS. 13A-13B.

FIG. 11C exemplarily illustrates knitting the first pair 1101 and the second pair 1102 using a latch needle 1108 for creating the fabric structure 1301 shown in FIGS. 13A-13B. The latch needle 1108 receives the first pair 1101 of threads 1101*a* and 1101*b* and the second pair 1102 of threads 1102*a* and 1102*b* at the same time to form the inner surface 1301*a* and the outer surface 1301*b* of the fabric structure 1301 simultaneously as exemplarily illustrated in FIG. 11C. The gauge of the first gripping thread 1101*a* and second gripping thread 1102*a* is, for example, in the range of about 1 millimeter diameter to about 0.3 millimeter diameter.

Figure 12:
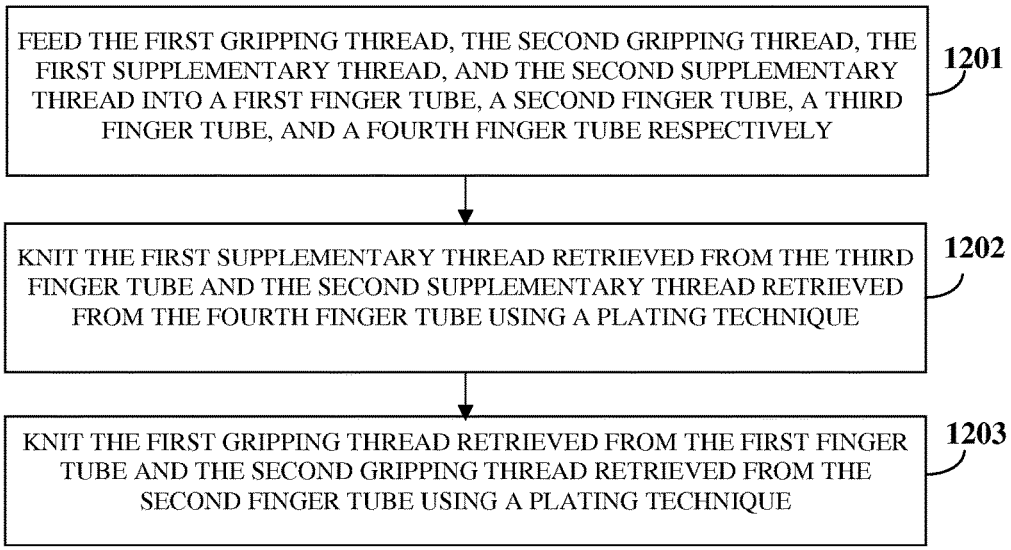
FIG. 12 exemplarily illustrates an embodiment for creating an inner surface and an outer surface of the fabric structure shown in FIGS. 13A-13B.

FIG. 12 exemplarily illustrates an embodiment for creating an inner surface 1301*a* and an outer surface 1301*b* of the fabric structure 1301 shown in FIGS. 13A-13B. Consider an example where there are four finger tubes active on the circular knitting machine 1109 exemplarily illustrated in FIG. 11B. The first gripping thread 1101*a*, the second gripping thread 1102*a*, the first supplementary thread 1101*b*, and the second supplementary thread 1102*b* are wound onto a first spool 1104*a*, a second spool 1104*b*, a third spool 1104*c*, and a fourth spool 1104*d* respectively as exemplarily illustrated in FIG. 11B. The first spool 1104*a* of the first gripping thread 1101*a*, the second spool 1104*b* of the second gripping thread 1102*a*, the third spool 1104*c* of the first supplementary thread 1101*b*, and the fourth spool 1104*d* of the second supplementary thread 1102*b* are placed onto the rack 1107 positioned on the knitting unit 1106 above a first finger tube, a second finger tube, a third finger tube, and a fourth finger tube respectively. The first gripping thread 1101*a*, the second gripping thread 1102*a*, the first supplementary thread 1101*b*, and the second supplementary thread 1102*b* are fed 1201 into the first finger tube, the second finger tube, the third finger tube, and the fourth finger tube respectively.

In this method of creating the fabric structure 1301 shown in FIG. 13B, the latch needles 1108 of the knitting machine 1109 exemplarily illustrated in FIG. 11B, simultaneously retrieve the first supplementary thread 1101*b* and the second supplementary thread 1102*b* from the third finger tube and the fourth finger tube respectively. The first supplementary thread 1101*b* retrieved from the third finger tube and the second supplementary thread 1102*b* retrieved from the fourth finger tube are knitted 1202, for example, using a plating technique, where the first supplementary thread 1101*b* goes to the inner surface 1301*a* of the fabric structure 1301, and the second supplementary thread 1102*b* goes to the outer surface 1301*b* of the fabric structure 1301. The first supplementary thread 1101*b* is exposed on the inner surface 1301*a* of the fabric structure 1301, and the second supplementary thread 1102*b* is exposed on the outer surface 1301*b* of the fabric structure 1301.

After a first course of knitting is complete, the latch needles 1108 on the circular knitting machine 1109 simultaneously retrieve the first gripping thread 1101*a* from the first finger tube and the second gripping thread 1102*a* from the second finger tube and knit 1203 the first gripping thread 1101*a* and the second gripping thread 1102*a* in the plating technique, where the first gripping thread 1101*a* goes to the inner surface 1301*a* of the fabric structure 1301 and the second gripping thread 1102*a* goes to the outer surface 1301*b* of the fabric structure 1301. The first gripping thread 1101*a* is exposed on the inner surface 1301*a* of the fabric structure 1301 but not exposed on the outer surface 1301*b* of the fabric structure 1301. The second gripping thread 1102*a* is exposed on the outer surface 1301*b* but not exposed on the inner surface 1301*a* of the fabric structure 1301. The first pair 1101 comprising the first gripping thread 1101*a* and the first supplementary thread 1101*b* defines the inner surface 1301*a* of the fabric structure 1301. The second pair 1102 comprising the second gripping thread 1102*a* and the second supplementary thread 1102*b* defines the outer surface 1301*b* of the fabric structure 1301.

The circular knitting machine 1109 then continues to alternate on each course of knitting between the gripping threads 1101*a* and 1102*a* and the supplementary threads 1101*b* and 1102*b* until the fabric structure 1301 shown in FIGS. 13A-13B is created. This technique is not limited to alternating between the gripping threads 1101*a* and 1102*a* and supplementary threads 1101*b* and 1102*b* on each course. As an example, the gripping threads 1101*a* and 1102*a* may be knitted into the fabric structure 1301 on the third course, the fourth course, or any combination thereof.

FIG. 13A exemplarily illustrates a fabric structure 1301 configured to conform to a user's body part. The fabric structure 1301 comprises an inner surface 1301*a* and an outer surface 1301*b*. For example, the fabric structure 1301 is configured to conform to a user's foot for constructing a garment, for example, a sock. The configured fabric structure 1301 can be selectively applied with the gripping material 402 on the inner surface 1301*a* and/or the outer surface 1301*b* of the configured fabric structure 1301 as disclosed in the detailed description of FIG. 15A-15B.

FIG. 13B exemplarily illustrates an enlarged sectional view of the fabric structure 1301. The fabric structure 1301 comprises an inner surface 1301*a* and an outer surface 1301*b* as exemplarily illustrated in FIG. 13A. The inner surface 1301*a* of the fabric structure 1301 is defined by a first pair 1101 comprising a first gripping thread 1101*a* and a first supplementary thread 1101*b*, and the outer surface 1301*b* of the fabric structure 1301 is defined by a second pair 1102 comprising a second gripping thread 1102*a* and a second supplementary thread 1102*b* as exemplarily illustrated in FIG. 13B. In an embodiment, the gripping material 402 is selectively applied on the first gripping thread 1101*a* and/or the first supplementary thread 1101*b* in the first pair 1101 that defines the inner surface 1301*a* of the fabric structure 1301, and on the second gripping thread 1102*a* and/or the second supplementary thread 1102*b* in the second pair 1102 that defines the outer surface 1301*b* of the fabric structure 1301 as exemplarily illustrated in FIGS. 15A-15B. For example, the gripping material 402 can be added or coated to the first gripping thread 1101*a* and/or the first supplementary thread 1101*b* in the first pair 1101, or on the second gripping thread 1102*a* and/or the second supplementary thread 1102*b* in the second pair 1102 at $1/16^{th}$ of an inch intervals rather than coating the entire length of the threads 1101*a*, 1101*b*, 1102*a*, and 1102*b* on the spools 1104*a*, 1104*c*, 1104*b*, and 1104*d* respectively, exemplarily illustrated in FIG. 11B. In an embodiment, the gripping material 402 can be added or coated on the entire length of the first gripping thread 1101*a* and/or the first supplementary thread 1101*b* in the first pair 1101, or on the second gripping thread 1102*a* and/or the second supplementary thread 1102*b* in the second pair 1102.

The gripping material 402 adheres to the first gripping thread 1101*a* and/or the first supplementary thread 1101*b* in the first pair 1101 and to the second gripping thread 1102*a* and/or the second supplementary thread 1102*b* in the second pair 1102. The gripping material 402 on the inner surface 1301*a* defined by the first pair 1101 and the outer surface 1301*b* defined by the second pair 1102 adheres to the user contact surface and the external contact surface respectively for providing enhanced grip between the user contact surface and the fabric structure 1301, and between the fabric structure 1301 and the external contact surface respectively.

FIGS. 14A-14D exemplarily illustrate multiple views of the fabric structure 1301 of FIGS. 13A-13B, showing a first pair 1101 comprising a first gripping thread 1101*a* and a first supplementary thread 1101*b* knitted with a second pair 1102 comprising a second gripping thread 1102*a* and a second supplementary thread 1102*b* for creating the fabric structure 1301. A bottom elevated view, a top view, and side views of the first pair 1101 comprising the first gripping thread 1101*a* and the first supplementary thread 1101*b* knitted with the second pair 1102 comprising the second gripping thread 1102*a* and the second supplementary thread 1102*b* are exemplarily illustrated in FIG. 14A, FIG. 14B, and FIGS. 14C-14D respectively. The fabric structure 1301 is made of traction, gripping yarn herein referred to as a first gripping thread 1101*a* and a second gripping thread 1102*a*, knitted with yarns made of a conventional material herein referred to as supplementary threads 1101*b* and 1102*b*. The first gripping thread 1101*a* and the second gripping thread 1102*a* are made of the same material. In an embodiment, the first gripping thread 1101*a* and the second gripping thread 1102*a* are made of different traction, gripping materials. The first gripping thread 1101*a* and the second gripping thread 1102*a* are, for example, made of a synthetic material such as a synthetic rubber, or a natural material such as latex also known as a natural rubber, or yarns coated with natural latex, polyvinyl chloride, thermoplastic rubber or thermoplastic elastomers, polyurethane, etc. In an embodiment, the gripping threads 1101*a* and 1102*a* are extruded vulcanized natural latex, gauge 68 and 75, made by the following company: Heveafil Sdn. Bdh., No. 1, Jalan Heveafil, 44300 Batang Kali, Ulu Selangor, Selangor Darul Ehsan, Malaysia.

The supplementary threads 1101*b* and 1102*b* are made, for example, of materials such as cotton, nylon, Lycra, acrylic, wool or other conventional materials used in the manufacture of, for example, socks, gloves, etc. In an embodiment, the fabric structure 1301 comprises a first type of supplementary thread 1101*b* used to define the inner surface 1301*a* of the fabric structure 1301 and a second type of supplementary thread 1102*b* used to define the outer surface 1301*b* of the fabric structure 1301. For example, the first supplementary thread 1101*b* used to define the inner surface 1301*a* of the fabric structure 1301, that accompanies the first gripping thread 1101*a*, is made of cotton, while the second supplementary thread 1102*b* used to define the outer surface 1301*b* of the fabric structure 1301, that accompanies the second gripping thread 1102*a* is, for example, made of nylon. In an embodiment, the supplementary threads 1101*b* and 1102*b* used for the inner surface 1301*a* and the outer surface 1301*b* are made of the same material.

For purposes of illustration, the detailed description of FIGS. 9-14D refers to the creation of the fabric structure 1301 by knitting a first pair 1101 comprising a first gripping thread 1101*a* and a first supplementary thread 1101*b*, and a second pair 1102 comprising a second gripping thread 1102*a* and a second supplementary thread 1102*b*. However, the scope of the method disclosed herein is not limited to the first pair 1101 and the second pair 1102 but may be extended to include multiple pairs of multiple threads. In an embodiment, the first pair 1101 of threads 1101*a* and 1101*b* and the second pair 1102 of threads 1102*a* and 1102*b* are knitted to create the fabric structure 1301 such that the inner surface 1301*a* of the fabric structure 1301 and the outer surface 1301*b* of the fabric structure 1301 are made of threads of the same gripping material-supplementary material. In an embodiment, different gripping material-supplementary material thread combinations are used for creation of the fabric structure 1301.

FIGS. 15A-15B exemplarily illustrate selective application of a gripping material 402 on a fabric structure 1301 configured to conform to a user's body part as shown in FIGS. 13A-13B, by spraying the gripping material 402 on the configured fabric structure 1301 to construct a gripping garment 400. The fabric structure 1301 is configured to conform to a user's body part, for example, the user's foot to construct, for example, a sock. In this embodiment, the configured fabric structure 1301 is herein referred to as a "sock". The sock configured from the fabric structure 1301 as disclosed in the detailed description of FIGS. 9-14D and as exemplarily illustrated in FIG. 13A, is herein referenced by the numeral 1301. As exemplarily illustrated in FIG. 15A, the gripping material 402, for example, in a liquid form is sprayed through a nozzle 601 onto the outer surface 1301*b* of the sock 1301. The gripping material 402 may also be selectively applied on the inner surface 1301*a* of the sock 1301, for example, by spraying the gripping material 402 on the inner surface 1301*a* of the sock 1301 in one or more of multiple patterns.

The gripping material 402 is selectively applied on the first gripping thread 1101*a* and/or the first supplementary thread 1101*b* in the first pair 1101 that defines the inner surface 1301*a* of the sock 1301, and on the second gripping thread 1102*a* and/or the second supplementary thread 1102*b* in the second pair 1102 that defines the outer surface 1301*b* of the sock 1301 exemplarily illustrated in FIGS. 13A-13B, for example, by spraying the gripping material 402 on selected areas on the inner surface 1301*a* and/or the outer surface 1301*b* of the sock 1301 in one or more of multiple patterns. As exemplarily illustrated in FIG. 15A, the gripping material 402 adheres to the first supplementary thread 1101*b* in the first pair 1101 and to the second gripping thread 1102*a* in the second pair 1102. The gripping material 402 on the inner surface 1301*a* defined by the first pair 1101 and the outer surface 1301*b* defined by the second pair 1102 adheres to the user contact surface and the external contact surface respectively for providing enhanced grip between the user contact surface and the sock 1301, and between the sock 1301 and the external contact surface respectively.

In an embodiment, the gripping material 402 is selectively applied on the first gripping thread 1101*a* and/or the first supplementary thread 1101*b* in the first pair 1101 that defines the inner surface 1301*a* of the sock 1301, and on the second gripping thread 1102*a* and/or the second supplementary thread 1102*b* in the second pair 1102 that defines the outer surface 1301*b* of the sock 1301 exemplarily illustrated in FIGS. 13A-13B, for example, by one or more of painting, pouring, screen printing, etc., the gripping material 402 on selected areas on the inner surface 1301*a* and/or the outer surface 1301*b* of the sock 1301 in one or more of multiple patterns.

Consider an example of constructing a foot gripping garment 400, as exemplarily illustrated in FIGS. 4A-8D, that provides grip to a user's foot between the user's foot and the foot gripping garment 400, and that simultaneously provides grip to the user's foot between the foot gripping garment 400 and an inside surface of footwear worn by the user. The footwear comprises, for example, shoes such as soccer shoes, basketball shoes, tennis shoes, running shoes, skate boots, ski boots, etc. In the method disclosed herein, the fabric structure 401 is configured to conform to the user's foot to create a foot enclosure, for example, a sock also referenced herein by the numeral 401 by knitting different natural yarns and/or synthetic yarns using a circular knitting machine 1109 as exemplarily illustrated in FIG. 11B. The natural yarns and/or the synthetic yarns are first wrapped or packaged on yarn cones or yarn spools by specific machinery and then shipped to knitting mills for the production of the foot enclosure. The yarn cones hang from racks 1107 overtop the circular knitting machine 1109. The natural yarns and/or the synthetic yarns from the yarn cones or the yarn spools are fed through finger tubes 1105*a* and 1105*b* and moved through a series of latch needles 1108 and sinkers that closely knit the sock 401 together. The top of the sock 401 is completed as a circular opening at the section of the sock 401 that pulls over the leg. The circular knitting machines 1109 create an opening at the bottom of the sock 401 that is completed on a separate machine into a toe seam. The created sock 401 is composed of any conventional fabric, for example, open end cotton, ring spun/combed cotton, Lycra, acrylic, nylon, wool, etc.

The sock 401 defines an inner surface 401*a* and an outer surface 401*b* as exemplarily illustrated in FIGS. 4A-4C. The inner surface 401*a* of the sock 401 is in close proximity to the user's foot and distal to the footwear, when the user is wearing the sock 401 and the footwear. The outer surface 401*b* of the sock 401 is distal to the user's foot and proximal to the footwear, when the user is wearing the sock 401 and the footwear. A gripping material 402 is selectively applied on the inner surface 401*a* and the outer surface 401*b* of the sock 401 to construct the foot gripping garment 400. The selective application of the gripping material 402 on the inner surface 401*a* and the outer surface 401*b* of the sock 401 is performed, for example, by painting, pouring, screen printing, spraying, etc., the gripping material 402 on the inner surface 401*a* and the outer surface 401*b* of the sock 401.

The gripping material 402 on the inner surface 401*a* and the outer surface 401*b* of the sock 401 simultaneously adheres to the user's foot and the inside surface of the footwear respectively, when the user is wearing the foot gripping garment 400 and the footwear. The adherence of the gripping material 402 on the inner surface 401*a* and the outer surface 401*b* of the sock 401 to the user's foot and the inside surface of the footwear respectively provides grip to the user's foot between the user's foot and the foot gripping garment 400, and simultaneously provides grip to the user's foot between the foot gripping garment 400 and the inside surface of the footwear, thereby preventing the user's foot from slipping inside the foot gripping garment 400 and prevents the foot gripping garment 400 from slipping inside the footwear by adhering to both the skin on the user's foot and the inside material or the inside surface of the footwear simultaneously.

In an embodiment, the selective application of the gripping material 402 on the inner surface 401*a* and the outer surface 401*b* of the sock 401 is performed as follows: A design frame 501 comprising one or more patterned holes 502 is created. The design frame 501 is, for example, a design mold comprising patterned holes 502, a screen, etc. The created design frame 501 is positioned on each of the inner surface 401*a* and the outer surface 401*b* of the sock 401. The design frame 501 is positioned, for example, over the top of the inner surface 401*a* of the sock 401 and over the top of the outer surface 401*b* of the sock 401. The gripping material 402 is selectively applied on the positioned design frame 501 on each of the inner surface 401*a* and the outer surface 401*b* of the sock 401. The gripping material 402 passes through the patterned holes 502 of the design frame 501 and adheres to each of the inner surface 401*a* and the outer surface 401*b* of the sock 401 in a pattern defined by the patterned holes 502 of the design frame 501.

Consider another example where a design frame 501 or mold with the patterned holes 502 or the screen is created and placed over the top of the outer surface 401*b* of the sock 401 as exemplarily illustrated in FIG. 5A. The gripping material 402, for example, thermoplastic rubber that is in a liquid form as the thermoplastic rubber is mixed in a solution base, or heated to a melting point, is sprayed, screen printed, poured or painted on the design frame 501 or the screen that is positioned on the outer surface 401*b* of the sock 401. The thermoplastic rubber passes through the patterned holes 502 in the design frame 501 or the screen and onto the outer surface 401*b* of the sock 401, thereby creating a pattern of the thermoplastic rubber on the outer surface 401*b* of the sock 401. The design frame 501 with the patterned holes 502 or the screen is also placed over the top of the inner surface 401*a* of the sock 401. The thermoplastic rubber is then sprayed, screen printed, poured or painted on the design frame 501 or the screen that is positioned on the inner surface 401*a* of the sock 401. The thermoplastic rubber passes through the holes 502 in the design frame 501 or the screen and onto inner surface 401*a* of the sock 401, thereby creating a pattern of the thermoplastic rubber on the inner surface 401*a* of the sock 401. The creation of the pattern of the thermoplastic rubber on the outer surface 401*b* and the inner surface 401*a* of the sock 401 allows the sock 401 to adhere, for example, to the skin of the user's foot and the inside surface of the user's footwear simultaneously, thereby inhibiting slippage between the user's foot and the inside surface of the user's footwear.

The selective application of the gripping material 402 on the inner surface 401*a* and the outer surface 401*b* of the sock 401 to construct the foot gripping garment 400 prevents the foot of a user, for example, a player, a sportsman, etc., wearing the foot gripping garment 400 from slipping inside the foot gripping garment 400 by providing grip to the user's foot between the foot and the foot gripping garment 400, and simultaneously prevents the user's foot from slipping inside the footwear by providing grip to the user's foot between the foot gripping garment 400 and the inside surface of the footwear.

In another embodiment, the selective application of the gripping material 402 on the inner surface 401*a* and the outer surface 401*b* of the sock 401 to construct the foot gripping garment 400 is performed, for example, by utilizing a heat press 407, as disclosed in the detailed description of FIGS. 4A-4C, for transferring the gripping material 402 to the inner surface 401*a* and the outer surface 401*b* of the sock 401. In this embodiment, the design frame 501, for example, the design frame 501 or the screen is not used. The selective application of the gripping material 402 to the inner surface 401*a* and the outer surface 401*b* of the sock 401 to construct the foot gripping garment 400, by the heat press 407 eliminates any slippage between the user's foot and the inner surface 401*a* of the sock 401, while simultaneously eliminating any slippage between the outer surface 401*b* of the sock 401 and the inside surface of the footwear, when the user wears the foot gripping garment 400 and the footwear.

Consider another example where a fabric structure 1301 as exemplarily illustrated in FIG. 13B is configured to conform to a user's hand and fingers using the circular knitting machine 1109 to create a hand enclosure, for example, a glove. To create the hand enclosure, the gripping threads 1101*a*, 1102*a*, etc., are separated into two separate spools 1104*a* and 1104*b* of gripping threads 1101*a*, 1102*a*, etc., using a twisting machine 1103 as exemplarily illustrated in FIG. 11A. The spools 1104*a* and 1104*b* of gripping threads 1101*a*, 1102*a*, etc., are placed on a rack 1107. The rack 1107 is positioned on a knitting unit 1106 as exemplarily illustrated in FIG. 11B.

A single gripping thread 1101*a* and a single strand of a first supplementary thread 1101*b*, for example, a cotton thread, are drawn simultaneously from the spools 1104*a* and 1104*c* respectively into the first finger tube 1105*a* for grouping into the first pair 1101. The first pair 1101 defines the inner surface of the hand enclosure. The second gripping thread 1102*a* and a single strand of the second supplementary thread 1102*b*, for example, a nylon thread, are drawn simultaneously from the spools 1104*b* and 1104*d* respectively into a second finger tube 1105*b* for grouping into the second pair 1102. The second pair 1102 defines the outer surface of the hand enclosure.

The first pair 1101 and the second pair 1102 are knitted using a latch needle 1108 as exemplarily illustrated in FIG. 11C. The latch needle 1108 receives the first pair 1101 and the second pair 1102 at the same time to form the inner surface and the outer surface simultaneously, for example, in a knitting pattern known as plating. The inner surface formed by the first pair 1101 comprising the first gripping thread 1101*a* and the first supplementary thread 1101*b* provide grip to the user's hand within the hand enclosure. The first pair 1101 may be knitted with the second pair 1102 in a twin-threaded pattern as exemplarily illustrated in FIGS. 14A-14D to create the hand enclosure. In an embodiment, a piece of conventional fabric made from, for example, cotton, nylon, wool, acrylic, polyester, polypropylene, and/or spandex is used for creating the hand enclosure.

In this example, a gripping material 402 is selectively applied on the inner surface of the hand enclosure to construct the gripping hand garment, for example, a gripping glove. The selective application of the gripping material 402 on the inner surface of the hand enclosure is performed, for example, by one or more of painting, pouring, screen printing, spraying, heat pressing, selectively attaching by sewing, etc., the gripping material 402 on the inner surface of the hand enclosure.

The gripping material 402 on the inner surface of the hand enclosure simultaneously adheres to the user's hand, when the user is wearing the gripping hand garment. The adherence of the gripping material 402 on the inner surface of the hand enclosure to the user's hand provides grip to the user's hand between the user's hand and the hand enclosure. The gripping hand garment therefore prevents the user's hand from slipping inside the gripping hand garment by adhering to the surface of the user's hand.

For purposes of illustration, the detailed description refers to construction of a foot gripping garment 400, for example, a gripping sock and a gripping hand garment, for example, a gripping glove using the method disclosed herein; however the scope of the method disclosed herein is not limited to the construction of a gripping sock and a gripping glove but may be extended to the construction of any gripping garment that can be worn by the user for obtaining grip.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

I claim:

1. A method for making a gripping sock, comprising:

providing a sock, said sock having a resistance to sliding motion between said sock and a foot of a user when said user is wearing said sock, said sock having a resistance to sliding motion between said sock and a shoe when said user is wearing said sock and said shoe;

applying a non-slip material on an inside surface and an outside surface of said sock to define the gripping sock, said non-slip material on said inside surface of said sock providing said resistance to sliding motion between said sock and said foot of said user when said user is wearing said sock that is greater than said resistance to sliding motion of said sock, said non-slip material on said outside surface of said sock providing said resistance to sliding motion between said sock and said shoe when said user is wearing said sock and said shoe that is greater than said resistance to sliding motion of said sock, whereby said non-slip material on said inside surface of said gripping sock frictionally engages said foot of said user when said user is wearing said gripping sock and whereby said non-slip material on said outside surface of said gripping sock frictionally engages said shoe when said user is wearing said gripping sock and said shoe, wherein said step of applying said non-slip material comprises:

applying said non-slip material to define a plurality of shapes on said inside surface and said outside surface of said sock, wherein said plurality of shapes of non-slip material on said inside surface sock has a correspondence with said plurality of shapes on said outside surface of said sock, and wherein said correspondence is that at least one said shape on said inside surface of said sock overlaps at least one said shape on said outside surface of said sock.

2. The method of claim 1, wherein said step of applying said non-slip material on said inside surface and said outside surface of said sock comprises: heat pressing for transferring and bonding said non-slip material to said inside surface and said outside surface of said sock.

3. The method of claim 1, wherein said step of applying said non-slip material on said inside surface and said outside surface of said sock comprises: spraying said nonslip material on said inside surface and said outside surface of said sock.

4. The method of claim 1, wherein said step of applying said plurality of shapes of non-slip material on said inside surface and said outside surface of said sock comprises: pouring said non-slip material on said inside surface and said outside surface of the sock.

5. The method of claim 1, wherein said step of applying said non-slip material on said inside surface and said outside surface of said sock comprises: one of painting and screen printing said non-slip material on said inside surface and said outside surface of said sock.

6. The method of claim 1, wherein said step of applying said non-slip material on said inside surface and said outside surface of said sock comprises: applying said non-slip material in one or more of a plurality of patterns to said inside surface and said outside surface of said sock.

7. The method of claim 6, wherein said step of applying said non-slip material on said inside surface and said outside surface of said sock comprises:

creating a design frame comprising one or more patterned holes;

positioning said created design frame on each of said inside surface and said outside surface of said sock; and applying said non-slip material on said positioned design frame on said each of said inside surface and said outside surface of the sock, wherein said non-slip material passes through said one or more patterned holes of said positioned design frame and adheres to said inside surface and said outside surface of the sock in a pattern defined by said one or more patterned holes of said positioned design frame.

8. The method of claim 7, wherein said step of applying said non-slip material on said positioned design frame comprises: one or more of painting, pouring, screen printing, and spraying said non-slip material using said positioned design frame to allow said non-slip material to pass through said one or more patterned holes of said positioned design frame and adhere to said inside surface and said outside surface of said sock in said pattern defined by said one or more patterned holes of said positioned design frame.

9. The method of claim 1, wherein said step of providing said sock comprises:

providing a gripping thread and a supplementary thread;

knitting said sock from said gripping thread and said supplementary thread, said gripping thread providing a greater resistance than said supplementary thread to said sliding motion between said sock and said foot of said user or between said sock and said shoe when said user is wearing said sock and said shoe.

10. The method of claim 9, wherein said steps of providing said gripping thread and said supplementary thread and knitting said sock comprise:

providing a first said gripping thread and a second said gripping thread;

providing a first said supplementary thread and a second said supplementary thread;

winding said first gripping thread, said second gripping thread, said first supplementary thread and said second supplementary thread onto a first spool, a second spool, a third spool, and a fourth spool respectively;

grouping said first gripping thread and said first supplementary thread into a first pair;

grouping said second gripping thread and said second supplementary thread into a second pair; and knitting said first pair with said second pair to form said sock, said first pair defining said inside surface of said sock, said second pair defining said outside surface of said sock, wherein said first gripping thread of said first pair is exposed on said inside surface of said sock and is not exposed on said outside surface of said sock, and wherein said second gripping thread of said second pair is exposed on said outside surface of said sock and is not exposed on said inside surface of said sock.

11. The method of claim 10, further comprising:

feeding said first gripping thread and said first supplementary thread from said first spool and said third spool respectively into a first finger tube; and feeding said second gripping thread and said second supplementary thread from said second spool and said fourth spool respectively into a second finger tube.

12. The method of claim 10, wherein said step of knitting said sock comprises:

feeding said first gripping thread, said second gripping thread, said first supplementary thread, and said second supplementary thread into a first finger tube, a second finger tube, a third finger tube, and a fourth finger tube respectively;

knitting said first supplementary thread retrieved from said third finger tube and said second supplementary thread retrieved from said fourth finger tube using a plating technique, wherein said first supplementary thread is exposed on said inside surface of said sock, and wherein said second supplementary thread is exposed on said outside surface of said sock; and knitting said first gripping thread retrieved from said first finger tube and said second gripping thread retrieved from said second finger tube using said plating technique, wherein said first gripping thread is exposed on said inside surface of said sock but not exposed on said outside surface of said sock, and wherein said second gripping thread is exposed on said outside surface of said sock but not exposed on said inside surface of said sock, and wherein a first pair of said first gripping thread and said first supplementary thread defines said inside surface of said sock, and a second pair of said second gripping thread and said second supplementary thread defines said outside surface of said sock.

13. The method of claim 9, wherein said gripping thread is composed of one or more of non-slip materials, tacky materials, and textured materials comprising one or more of synthetic rubber, natural latex, polyvinyl chloride, thermoplastic rubber, thermoplastic elastomers, and polyurethane.

14. The method of claim 9, wherein said step of providing said gripping thread comprises: coating said gripping thread with one or more of a synthetic rubber, a natural latex, a polyvinyl chloride, a thermoplastic rubber, a thermoplastic elastomer, and a polyurethane.

15. The method of claim 9, wherein said step of providing said gripping thread comprises: coating a portion of said gripping thread with one or more of a synthetic rubber, a natural latex, a polyvinyl chloride, a thermoplastic rubber, a thermoplastic elastomer, and a polyurethane.

* * * * *